US011104553B2

(12) United States Patent
Maedo

(10) Patent No.: US 11,104,553 B2
(45) Date of Patent: Aug. 31, 2021

(54) CRAWLER CRANE

(71) Applicant: KOBELCO CONSTRUCTION MACHINERY CO., LTD., Hiroshima (JP)

(72) Inventor: Teppei Maedo, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 138 days.

(21) Appl. No.: 16/425,124

(22) Filed: May 29, 2019

(65) Prior Publication Data

US 2019/0367333 A1 Dec. 5, 2019

(30) Foreign Application Priority Data

May 30, 2018 (JP) ..... JP2018-103570

(51) Int. Cl.
*B66C 9/10* (2006.01)
*B66C 23/62* (2006.01)

(52) U.S. Cl.
CPC ..... *B66C 9/10* (2013.01); *B66C 23/62* (2013.01); *B66C 2700/0364* (2013.01)

(58) Field of Classification Search
CPC ..... B66C 9/10; B66C 23/26; B66C 23/62; B66C 2700/0364; B62D 21/08
USPC ..... 180/9.1
See application file for complete search history.

(56) References Cited

U.S. PATENT DOCUMENTS 3,757,881 A * 9/1973 Short ..... B62D 55/084 180/9.1
7,997,432 B2 * 8/2011 Porubcansky ..... B66C 23/62 212/301
2004/0108292 A1 6/2004 Smith et al.
2009/0289495 A1 * 11/2009 Zollondz ..... B66C 23/36 305/120
2019/0390440 A1 * 12/2019 Motoyama ..... B66C 23/74
2020/0039799 A1 * 2/2020 Motoyama ..... B66C 23/62

FOREIGN PATENT DOCUMENTS

JP 2004-189219 7/2004

* cited by examiner

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A crawler crane includes a lower traveling body, and the lower traveling body includes: a car body; a right crawler device and a left crawler device; a front side connecting portion; and a rear side connecting portion, the right crawler device includes a right crawler frame, the left crawler device includes a left crawler frame, the front side connecting portion is separably joined to each of a front end portion of the car body, the right crawler frame front portion and the left crawler frame front portion, the rear side connecting portion is separably joined to each of a rear end portion of the car body, the right crawler frame rear portion and the left crawler frame rear portion, and each of the front side connecting portion and the rear side connecting portion includes a lattice portion which has a lattice structure.

10 Claims, 11 Drawing Sheets

CRAWLER CRANE

TECHNICAL FIELD

The present invention relates to a crawler crane.

BACKGROUND ART

Conventionally, there has been known a crawler crane including a lower traveling body which is configured to travel by a crawler device. JP 2004-189219 A discloses one example of such a crawler crane.

The crawler crane disclosed in JP 2004-189219 A includes: a lower traveling body; and an upper slewing body mounted on the lower traveling body in a slewable manner about a slewing axis extending in a vertical direction. The lower traveling body includes: a vehicle body which supports the upper slewing body from below; and a pair of crawler devices provided on both left and right sides of a vehicle body. The upper slewing body has: a slewing frame mounted on the vehicle body in a slewable manner; and an attachment for a hanging operation including a boom or a mast mounted on the slewing frame.

Each of the pair of crawler devices includes: a crawler frame which extends in a front-rear direction; and a crawler which is disposed so as to surround the crawler frame.

Each of the pair of crawler devices is configured to make the lower traveling body travel by driving the crawler.

However, the above-mentioned conventional crawler crane has a problem that it is difficult to overcome the restrictions at the time of transporting the lower traveling body while enhancing hanging ability.

Specifically, in a crawler crane, a magnitude of a hanging load which can be hung by an attachment on an upper slewing body, that is, hanging ability of the crawler crane is determined based on the degree of stability of the crawler crane against falling of the crawler crane in a front-rear direction. Accordingly, to enhance hanging ability of the crawler crane, it is necessary to increase the degree of stability of the crawler crane against falling of the crawler crane in the front-rear direction. Falling of the crawler crane in the front-rear direction can be prevented by making portions of left and right crawler devices of a lower traveling body which protrude frontward and rearward from a car body stand firm against the ground.

Accordingly, to enhance the hanging ability of the crawler crane, it is necessary to reduce a deflection amount in a vertical direction of the protruding portions of the left and right crawler devices when a force which may cause the crawler crane to fall frontward or rearward acts on the crawler crane. Specifically, it is necessary to reduce a deflection amount in a vertical direction of portions of left and right crawler frames which protrude frontward and rearward from the car body. For example, by increasing a size of the car body in the front-rear direction and by connecting the crawler frames to the car body at positions closer to front ends and rear ends of the left and right crawler frames, rigidity of the lower traveling body is enhanced. As a result, it is possible to reduce a deflection amount in a vertical direction of the portions of the left and right crawler frames protruding frontward and rearward from the car body. However, in this case, there arises a different problem that it is difficult to overcome restrictions at the time of transporting the lower traveling body.

Specifically, at the time of transporting the crawler crane, the lower traveling body and the upper slewing body are separated from each other, each of the lower traveling body and the upper slewing body is disassembled into a plurality of constitutional members, and the disassembled constitutional members are loaded on a transport vehicle such as a trailer and are transported on a public road. In this case, the lower traveling body is disassembled into the car body and the left and right crawler devices, and the lower traveling body is loaded on a transport vehicle and transported on a public road in a disassembled state. However, restriction is imposed on sizes and weights of the members which are allowed to be loaded on a transport vehicle which travels on a public road. Accordingly, in the case of increasing the size of the car body in the front-rear direction as described above, there is a concern that the size of the car body cannot overcome the restriction. Further, a weight of the car body is increased along with the increase in size of the car body and hence, there is a concern that the weight of the car body also cannot overcome the restriction.

SUMMARY OF INVENTION

Accordingly, it is an object of the present invention to provide a crawler crane which can solve the above-mentioned problems.

It is another object of the present invention to provide a crawler crane capable of overcoming restriction at the time of transporting a lower traveling body while enhancing hanging ability.

According to an aspect of the present invention, a crawler crane includes: a crawler-type lower traveling body which is capable of self-traveling; and an upper slewing body which is mounted on the lower traveling body in a slewable manner about a slewing axis which extends in a vertical direction. The lower traveling body includes: a car body which supports the upper slewing body from below so that the upper slewing body is slewable, a right crawler device and a left crawler device which are separately disposed on a right side and a left side of the car body and enable traveling of the lower traveling body, a front side connecting portion which interconnects a front end portion of the car body, the right crawler device and the left crawler device; and a rear side connecting portion which interconnects a rear end portion of the car body, the right crawler device and the left crawler device. The right crawler device includes a right crawler frame which is separably connected to a right end portion of the car body and extends in a front-rear direction, and a right crawler which is disposed so as to surround the right crawler frame and is brought into contact with a ground and performs a circulating motion to generate a propulsion force toward a front side or toward a rear side. The left crawler device includes a left crawler frame which is separably connected to a left end portion of the car body and extends in the front-rear direction, and a left crawler which is disposed so as to surround the left crawler frame and is brought into contact with a ground and performs a circulating motion to generate a propulsion force toward a front side or toward a rear side. The right crawler frame has a right crawler frame front portion which protrudes more frontward than a front end of the car body, and a right crawler frame rear portion which protrudes more rearward than a rear end of the car body. The left crawler frame has a left crawler frame front portion which protrudes more frontward than the front end of the car body, and a left crawler frame rear portion which protrudes more rearward than the rear end of the car body. The front side connecting portion is separably joined to each of the front end portion of the car body, the right crawler frame front portion and the left crawler frame front portion, the front side connecting portion configured to interconnect the front end portion of the car body, the right crawler frame front portion and the left crawler frame front portion in a state where the front side connecting portion is joined to each of the front end portion of the car body, the right crawler frame front portion and the left crawler frame front portion. The rear side connecting portion is separably joined to each of the rear end portion of the car body, the right crawler frame rear portion and the left crawler frame rear portion, the rear side connecting portion configured to interconnect the rear end portion of the car body, the right crawler frame rear portion and the left crawler frame rear portion in a state where the rear side connecting portion is joined to each of the rear end portion of the car body, the right crawler frame rear portion and the left crawler frame rear portion. Each of the front side connecting portion and the rear side connecting portion includes a lattice portion which has a lattice structure.

DESCRIPTION OF EMBODIMENTS

Hereinafter, an embodiment of the present invention is described.

Figure 1:
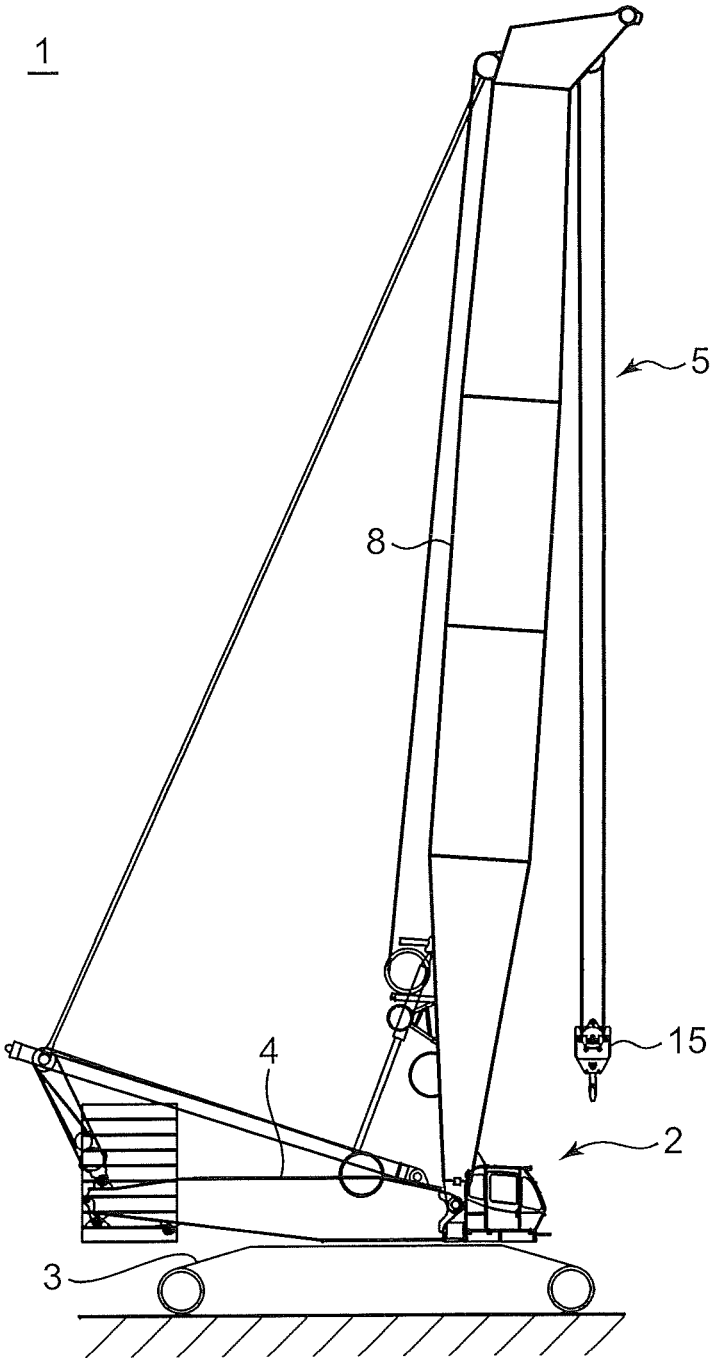
FIG. 1 is a side view of a crawler crane having a crane specification according to one embodiment of the present invention.
Figure 2:
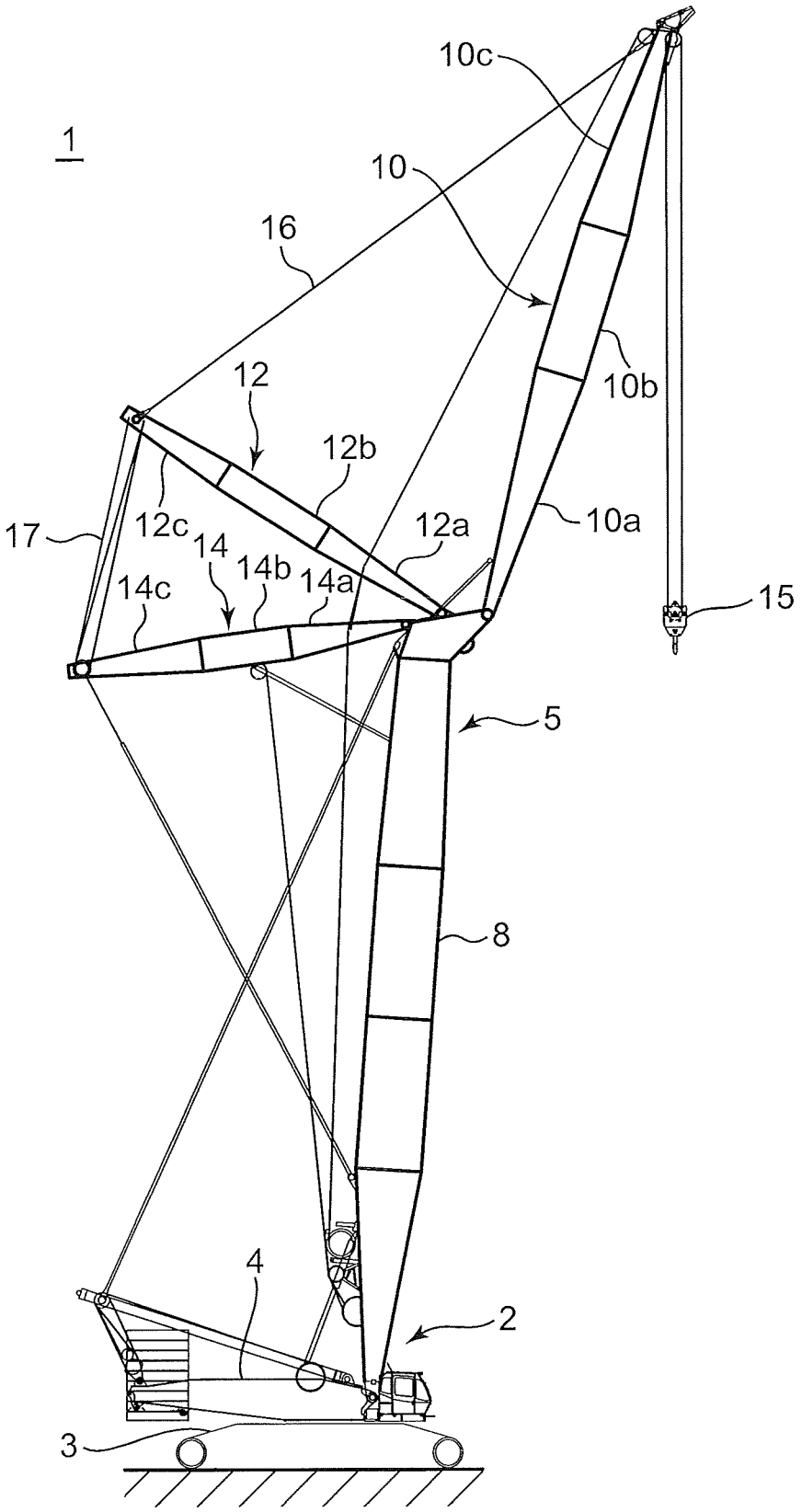
FIG. 2 is a side view of a crawler crane having a luffing specification according to one embodiment of the present invention.
Figure 3:
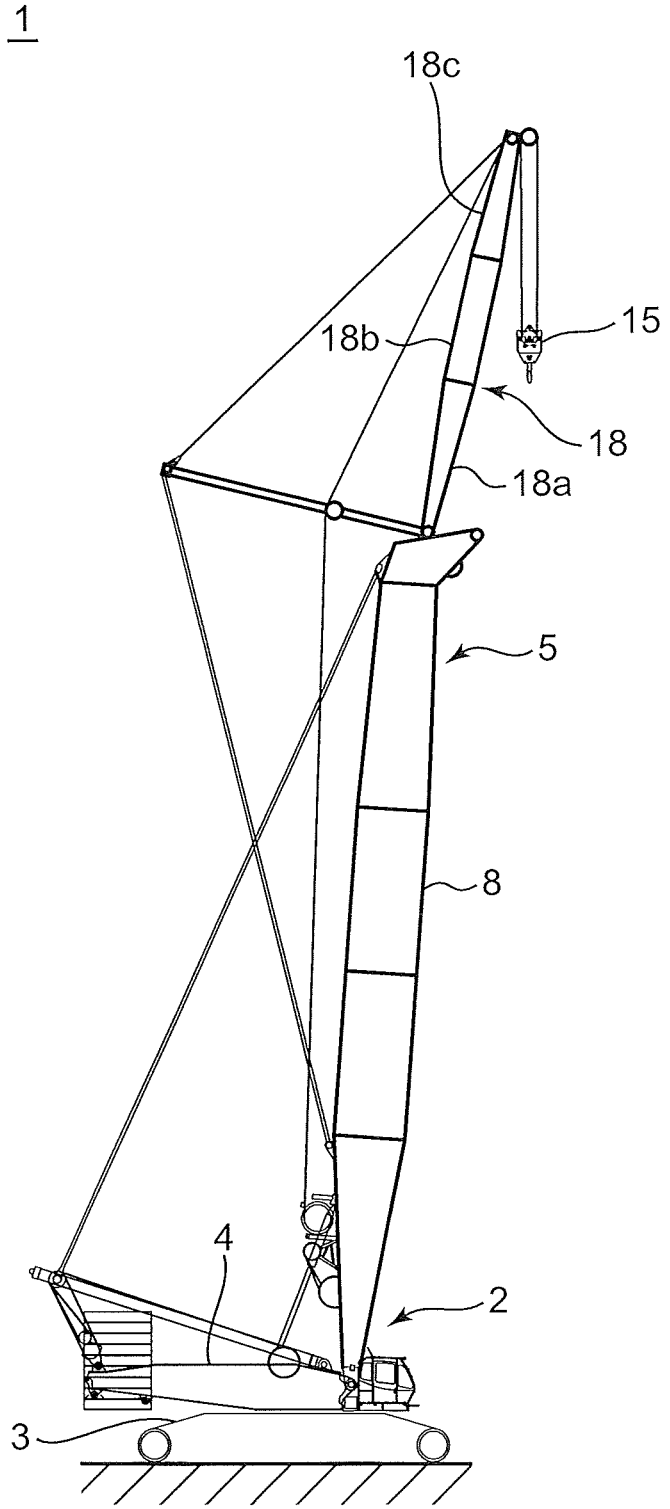
FIG. 3 is a side view of a crawler crane having a fixing jib specification according to one embodiment of the present invention.

As shown in FIG. 1 to FIG. 3, a crawler crane 1 according to this embodiment includes: an upper slewing body 2; and a lower traveling body 3.

The upper slewing body 2 is mounted on the lower traveling body 3 in a slewable manner about a slewing axis extending in a vertical direction. The upper slewing body 2 includes: a slewing body main part 4; and an attachment 5 for performing a hanging operation.

The slowing body main part 4 is mounted on the lower traveling body 3 in a slewable manner. The attachment 5 is disposed on the slewing body main part 4.

The attachment 5 is configured to be capable of being modified in various modes based on a specification of a crawler crane 1 selected according to a mode of a hanging operation. Specifically, the crawler crane 1 may have a crane specification shown in FIG. 1, a luffing specification shown in FIG. 2, and a fixing jib specification shown in FIG. 3.

In the crane specification shown in FIG. 1, the attachment 5 includes a boom 8 and a hanging tool 15. The boom 8 has: a proximal end portion which is one end portion in a longitudinal direction of the boom 8 and mounted on the slewing body main part 4 in a rotatable manner about a horizontal axis; and a distal end portion which is an end portion on a side opposite to the proximal end portion of the boom 8. The boom 8 is provided on the slewing body main part 4 in a state where the boom 8 can be raised and lowered using the proximal end portion of the boom 8 as a fulcrum. The boom 8 extends upward from the slewing body main part 4 at an arbitrary raised angle. The hanging tool 15 is hung from the distal end portion of the boom 8 such that the hanging tool 15 can be lifted and lowered. A hanging load is hung by the hanging tool 15, and a hanging operation is performed by raising or lowering the boom 8 and by lifting and lowering the hanging tool 15.

In the luffing specification shown in FIG. 2, the attachment 5 includes the boom 8, a luffing jib 10, a front strut 12, a rear strut 14, and the hanging tool 15.

The configuration of the boom 8 in the lulling specification is similar to the configuration of the boom 8 in the above-mentioned crane specification.

The luffing jib 10 has: a proximal end portion which is one end portion of the luffing jib 10 in a longitudinal direction of the luffing jib 10 and mounted on a distal end portion of the boom 8 in a rotatable manner about a horizontal axis; and a distal end portion which is an end portion on a side opposite to the proximal end portion of the luffing jib 10. The luffing jib 10 linearly extends from the proximal end portion thereof to the distal end portion thereof on a side opposite to the proximal end portion. The luffing jib 10 is detachably mounted on the distal end portion of the boom 8. The hanging tool 15 is hung from the distal end portion of the luffing jib 10 such that the hanging tool 15 is capable of being lifted and lowered, and a hanging load is hung by the hanging tool 15.

The luffing jib 10 has a proximal end jib 10*a*, an intermediate jib 10*b*, and a distal end jib 10*c*. The proximal end jib 10*a*, the intermediate jib 10*b*, and the distal end jib 10*c* are arranged in this order from the proximal end portion toward the distal end portion of the luffing jib 10. The luffing jib 10 is formed by connecting the jibs disposed adjacently to each other among these jibs 10*a*, 10*b*, 10*c*. Although not illustrated, the proximal end jib 10*a*, the intermediate jib 10*b* and the distal end jib 10*c* each have a lattice structure. The proximal end jib 10*a* and the intermediate jib 10*b* are detachably joined to each other, and the intermediate jib 10*b* and the distal end jib 10*c* are detachably joined to each other.

The front strut 12 has: a proximal end portion which is one end portion of the front strut 12 in a longitudinal direction of the front strut 12 and mounted on the distal end portion of the boom 8 in a rotatable manner about a horizontal axis behind the luffing jib 10; and a distal end portion which is an end portion on a side opposite to the proximal end portion of the front strut 12. The front strut 12 linearly extends from the proximal end portion thereof toward the distal end portion thereof on a side opposite to the proximal end portion. The front strut 12 is detachably mounted on the distal end portion of the boom 8. The distal end portion of the front strut 12 is connected to the distal end portion of the luffing jib 10 through a guy line 16.

The front strut 12 has a proximal end strut 12*a*, an intermediate strut 12*b*, and a distal end strut 12*c*. The proximal end strut 12*a*, the intermediate strut 12*b*, and the distal end strut 12*c* are arranged in this order from the proximal end portion toward the distal end portion of the front strut 12. The front strut 12 is formed by connecting the struts disposed adjacently to each other among these struts 12*a*, 12*b* and 12*e*. Although not illustrated, the proximal end strut 12*a*, the intermediate strut 12*b*, and the distal end strut 12*c* each have a lattice structure. The proximal end strut 12*a* and the intermediate strut 12*b* are detachably joined to each other, and the intermediate strut 12*b* and the distal end strut 12*e* are detachably joined to each other.

The rear strut 14 has: a proximal end portion which is one end portion of the rear strut 14 in a longitudinal direction of the rear strut 14 and mounted on the distal end portion of the boom 8 in a rotatable manner about a horizontal axis behind the front strut 12; and a distal end portion which is an end portion on a side opposite to the proximal end portion of the rear strut 14. The rear strut 14 linearly extends from the proximal end portion toward the distal end portion thereof. The rear strut 14 is detachably mounted on the distal end portion of the boom 8. A jib raising/lowering rope 17 is extended between and wound around the distal end portion of the rear strut 14 and the distal end portion of the front strut 12. The jib raising/lowering rope 17 extends toward a proximal end portion side of the boom 8. By pulling the jib raising/lowering rope 17 toward the proximal end portion side of the boom 8, the front strut 12 is rotated such that the distal end portion of the front strut 12 is drawn toward a rear strut 14 side and, at the same time, the luffing jib 10 is rotated in a direction in which the luffing jib 10 is raised. On the other hand, when the jib raising/lowering rope 17 is fed toward the rear strut 14 side, the front strut 12 is rotated such that the distal end portion of the front strut 12 is moved away from the rear strut 14 and, at the same time, the luffing jib 10 is rotated in a direction in which the luffing jib 10 is lowered.

The rear strut 14 has a proximal end strut 14*a*, an intermediate strut 14*b*, and a distal end strut 14*c*. The proximal end strut 14*a*, the intermediate strut 14*b*, and the distal end strut 14*c* are arranged in this order from the proximal end portion toward the distal end portion of the rear strut 14, and the struts disposed adjacently to each other among these struts 14*a*, 14*b*, and 14*c* are connected to each other thus forming the rear strut 14. Although not illustrated, the proximal end strut 14*a*, the intermediate strut 14*b* and the distal end strut 14*c* each have a lattice structure. The proximal end strut 14*a* and the intermediate strut 14*b* are detachably joined to each other, and the intermediate strut 14*b* and the distal end strut 14*c* are detachably joined to each other.

In this luffing specification, when the rear strut 14 is rotated, the front strut 12 is also rotated along with the rotation of the rear strut 14, and the luffing jib 10 is rotated with respect to the distal end portion of the boom 8. The hanging operation is performed due to the rotation of the luffing jib 10, the raising/lowering of the boom 8, and the lifting/lowering of the hanging tool 15.

In the fixing jib specification shown in FIG. 3, the attachment 5 has a boom 8, a fixing jib 18, and a hanging tool 15. The boom 8 in the fixing jib specification has a configuration similar to that of the boom 8 in the crane specification.

The fixing jib 18 has: a proximal end portion which is one end portion of the fixing jib 18 in a longitudinal direction of the fixing jib 18 and mounted on a distal end portion of the boom 8; and a distal end portion which is an end portion on a side opposite to the proximal end portion of the fixing jib 18. The fixing jib 18 linearly extends from the proximal end portion thereof toward the distal end portion thereof on a side opposite to the proximal end portion. The fixing jib 18 is detachably mounted on the distal end portion of the boom 8. The fixing jib 18 extends in substantially the same direction as an axial direction of the boom 8 in a state where the fixing jib 18 is mounted on the distal end portion of the boom 8. Unlike the luffing jib 10, the fixing jib 18 is not rotatable relative to the boom 8, and is mounted on the boom 8 in a state where a posture of the fixing jib 18 with respect to the boom 8 is fixed. Accordingly, the fixing jib 18 is raised and lowered integrally with the boom 8. In the fixing jib specification, the hanging tool 15 is hung from the distal end portion of the fixing jib 18 such that the hanging tool 15 can be lifted or lowered, and a hanging load is hung from the hanging tool 15.

The fixing jib 18 has a proximal end jib 18*a*, an intermediate jib 18*b*, and a distal end jib 18*c*. The proximal end jib 18*a*, the intermediate jib 18*b*, and the distal end jib 18*c* are arranged in this order from a proximal end portion toward a distal end portion of the fixing jib 18, and the jibs disposed adjacently to each other among these jibs 18*a*, 18*b* and 18*c* are connected to each other thus forming the fixing jib 18. Although not illustrated, the proximal end jib 18*a*, the intermediate jib 18*b*, and the distal end jib 18*c* each have a lattice structure. The proximal end jib 18*a* and the intermediate jib 18*b* are detachably joined to each other, and the intermediate jib 18*b* and the distal end jib 18*c* are detachably joined to each other.

In this fixing jib specification, a hanging operation is performed due to the integral raising/lowering of the boom 8 and the fixing jib 18, and the lifting/lowering of the hanging tool 15.

Any one of the above-mentioned crane specification, luffing specification, and fixing jib specification is selected according to a mode of a hanging operation which is performed by the crawler crane 1. Further, the luffing jib 10, the front strut 12, the rear strut 14, and the fixing jib 18 are exchangeably mounted such that the attachment 5 has a mode corresponding to the selected specification. Specifically, when the crane specification is selected, none of the luffing jib 10, the front strut 12, the rear strut 14 and the fixing jib 18 is mounted on the distal end portion of the boom 8. When the luffing specification is selected, the luffing jib 10, the front strut 12, and the rear strut 14 are mounted on the distal end portion of the boom 8, and the fixing jib 18 is not mounted on the distal end portion of the boom 8. When the fixing jib specification is selected, the fixing jib 18 is mounted on the distal end portion of the boom 8, and none of the luffing jib 10, the front strut 12, and the rear strut 14 is mounted on the distal end portion of the boom 8. The luffing jib 10, the front strut 12, the rear strut 14 and the fixing jib 18 respectively correspond to optional members detachably mounted on the distal end portion of the boom 8 in the present invention.

At least one of the intermediate jib 10*b* of the luffing jib 10, the intermediate strut 12*b* of the front strut 12, and the intermediate strut 14*b* of the rear strut 14 has the same structure as a front side connecting portion 38 and a rear side connecting portion 40 described later of the lower traveling body 3 so that at least one of the intermediate jib 10*b*, the intermediate strut 12*b*, and the intermediate strut 14*b* can be used as the front side connecting portion 38 and the rear side connecting portion 40. The intermediate jib 18*b* of the fixing jib 18 also has the same structure as the front side connecting portion 38 and the rear side connecting portion 40 so that the intermediate jib 18*b* can be used as the front side connecting portion 38 and the rear side connecting portion 40 described later. The intermediate jib 10*b*, the intermediate strut 12*b*, the intermediate strut 14*b*, and the intermediate jib 18*b* are merely examples of constitutional members of the present invention which are separable from the optional members.

Figure 4:
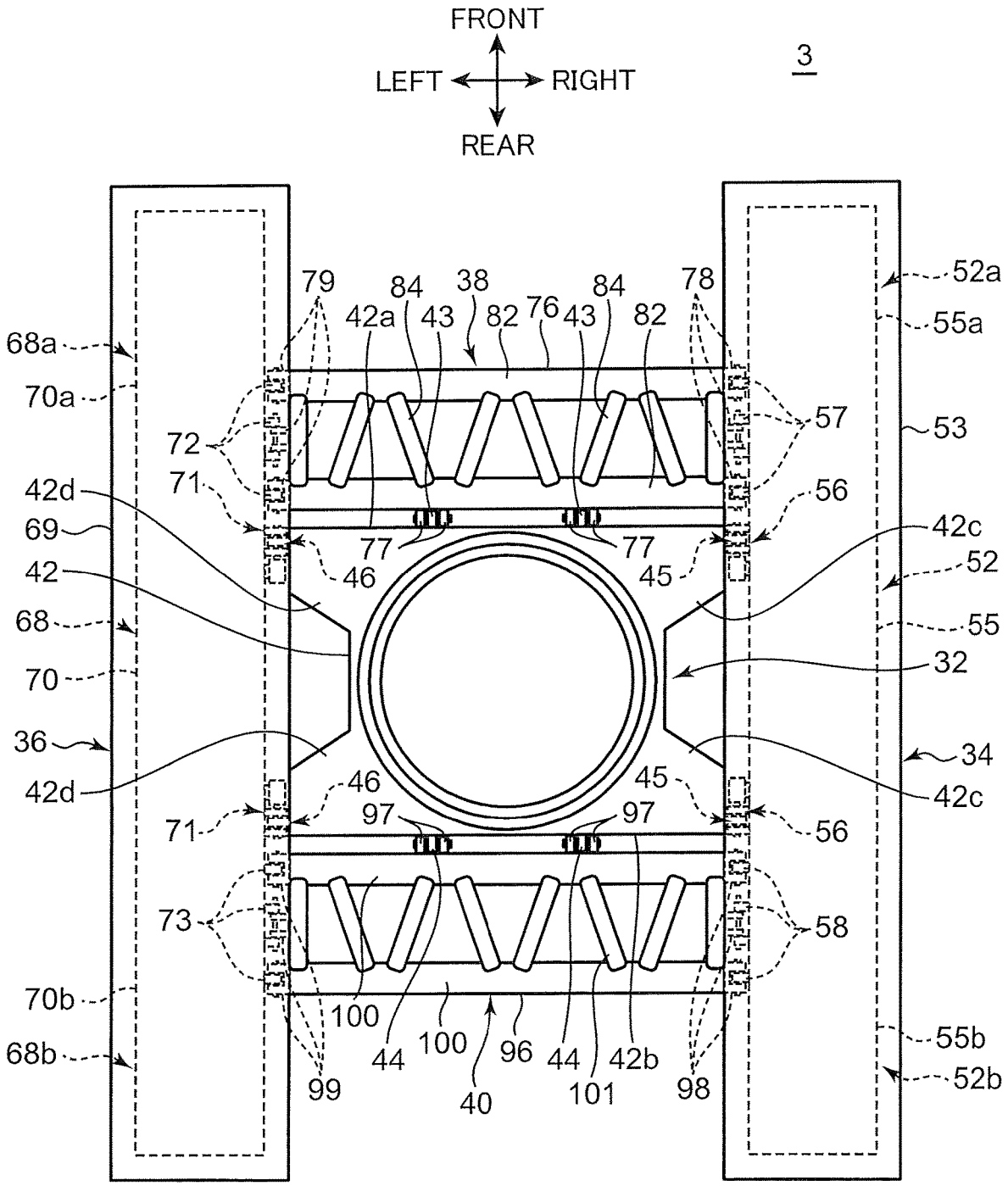
FIG. 4 is a view showing only a lower traveling body of the crawler crane according to one embodiment of the present invention as viewed from above.

The lower traveling body 3 is of a crawler type, and is configured to enable self-traveling. As shown in FIG. 4, the lower traveling body 3 has a car body 32, a right crawler device 34, a left crawler device 36, the front side connecting portion 38, and the rear side connecting portion 40. With respect to the lower traveling body 3, "front side" means a side in a traveling direction of the lower traveling body 3, and means an advancing direction side which is preliminarily set with respect to the lower traveling body 3. With respect to the lower traveling body 3, "rear side" means a side opposite to the front side. Further, with respect to the lower traveling body 3, "right side" means a right side when the lower traveling body 3 is viewed in a direction from a rear side toward a front side, and "left side" means a left side when the lower traveling body 3 is viewed in a direction from a rear side toward a front side.

The car body 32 is positioned at the center of the lower traveling body 3, and supports the upper slewing body 2 from below such that the upper slewing body 2 is slewable about a vertical axis. The car body 32 has a car body main part 42, a plurality of front mounting portions 43, a plurality of rear mounting portions 44, a plurality of right mounting portions 45, and a plurality of left mounting portions 46.

The car body main part 42 forms the most part of the car body 32. The car body main part 42 supports the upper slewing body 2 from below. The car body main part 42 has: a front end portion 42*a* having a front end surface, which extends in a left-right direction (lateral direction), expands in the vertical direction, and faces frontward; and a rear end portion 42*b* having a rear end surface, which is disposed parallel to the front end surface and faces rearward. The car body main part 42 has a pair of right side portions 42*c* which forms two divided portions in the front-rear direction and extends rightward, and a pair of left side portions 42*d* which forms two divided portions in the front-rear direction and extends leftward. Right distal end portions of the pair of right side portions 42*c* form a right end portion of the car body main part 42, and left distal end portions of the pair of left side portions 42*d* form a left end portion of the car body main part 42.

The front mounting portions 43 are portions to which the front side connecting portion 38 is mounted. The front mounting portions 43 are provided on the front end portion 42*a* of the car body main part 42. Specifically, the front mounting portions 43 are provided at two places of the car body main part 42 vertically spaced apart from each other at the position on a right side from the center of the car body main part 42 in the left-right direction by a predetermined distance in the front end surface of the front end portion 42*a*, and at two places of the car body main part 42 vertically spaced apart from each other at the position on a left side from the center of the car body main part 42 in the left-right direction by a distance equal to the above-mentioned predetermined distance in the front end surface of the front end portion 42*a*. In FIG. 4, among the front mounting portions 43 at four places, only the front mounting portions 43 on an upper side are shown, and the front mounting portions 43 on a lower side are not shown.

Each front mounting portion 43 is formed of a plate-like member which protrudes frontward from the front end surface of the front end portion 42*a*, and is disposed such that plate surfaces of the plate-like member extend along the vertical direction. A through hole is formed in each front mounting portion 43 so as to penetrate the front mounting portion 43 in the left-right direction.

The rear mounting portions 44 are portions to which the rear side connecting portion 40 is mounted. The rear mounting portions 44 are provided on the rear end portion 42*b* of the car body main part 42. Specifically, on a rear end surface of the rear end portion 42*b*, the rear mounting portions 44 are provided at four places where the rear mounting portions 44 become symmetrical in the front-rear direction with the front mounting portions 43 provided at four places on the front end surface. In FIG. 4, among the rear mounting portions 44 at four places, only the rear mounting portions 44 on the upper side are shown, and the rear mounting portions 44 on the lower side are not shown.

Each rear mounting portion 44 is formed of a plate-like member which protrudes rearward from the rear end surface of the rear end portion 42*h*, and is formed similarly to the front mounting portion 43. A through hole is formed in each rear mounting portion 44 so as to penetrate the rear mounting portion 44 in the left-right direction.

The right mounting portions 45 are portions on which a right crawler frame 52 described later of the right crawler device 34 is mounted. The right mounting portions 45 are provided on right ends of the pair of right side portions 42*c* of the car body main part 42 respectively. Each right mounting portion 45 is formed of a plate-like member which protrudes rightward from a right end of the corresponding right side portion 42*c*, and is disposed such that plate surfaces of the right mounting portion 45 extend along the vertical direction. A through hole is formed in each right mounting portion 45 so as to penetrate the right mounting portion 45 in the front-rear direction.

The left mounting portions 46 are portions on which a left crawler frame 68 described later of the left crawler device 36 is mounted. The left mounting portions 46 are provided on left ends of the pair of left side portions 42*d* of the car body main part 42 respectively. Each left mounting portion 46 is formed of a plate-like member which protrudes leftward from a right end of the corresponding left side portion 42*d*, and is disposed such that plate surfaces of the left mounting portion 46 extend along the vertical direction. A through hole is formed in each left mounting portion 46 so as to penetrate the left mounting portion 46 in the front-rear direction.

The right crawler device 34 and the left crawler device 36 are traveling devices which enable traveling of the lower traveling body 3. The right crawler device 34 and the left crawler device 36 are respectively disposed on a right side and a left side of the car body 32 and mounted on the car body 32.

The right crawler device 34 includes the right crawler frame 52, a right crawler 53, and a right crawler drive unit (not illustrated).

The right crawler frame 52 is a frame which supports the right crawler 53 by way of a driving wheel, a driven wheel, and the like of the right crawler drive unit (not illustrated) mounted on the right crawler frame 52. The right crawler frame 52 is connected to a right end portion of the car body 32 in a separable manner, and extends in the front-rear direction. The right crawler frame 52 has a right crawler frame front portion 52*a* which protrudes more frontward than a front end of the car body 32, and a right crawler frame rear portion 52*b* which protrudes more rearward than a rear end of the car body 32.

Specifically, the right crawler frame 52 has: a right crawler frame body 55 which is disposed on a right side of the car body 32 and linearly extends in the front-rear direction; and a plurality of side portion joining portions 56; a front portion joining portion 57; and a rear portion joining portion 58 each provided on the right crawler frame body 55.

The right crawler frame body 55 forms the most part of the right crawler frame 52. The right crawler frame body 55 has: a front portion 55*a* which protrudes and extends more frontward than the front end portion 42*a* of the car body main part 42; and a rear portion 55*b* which protrudes and extends more rearward than the rear end portion 42*b* of the car body main part 42.

The side portion joining portions 56 are portions which are separably joined to the right mounting portions 45 of the car body 32. The right crawler frame 52 is connected to the car body 32 by joining the side portion joining portions 56 to the right mounting portions 45. The side portion joining portions 56 are provided on a left side surface of an intermediate portion of the right crawler frame body 55 between the front portion 55*a* and the rear portion 55*b* at two places spaced apart from each other in the front-rear direction. The side portion joining portions 56 at two places are disposed at positions which correspond to the positions of the right mounting portions 45 at two places of the car body 32 in the front-rear direction. The configuration of the side portion joining portion 56 on a front side is similar to the configuration of the side portion joining portion 56 on a rear side. Out of these side portion joining portions 56, the side portion joining portion 56 on a front side is representatively shown in FIG. 7.

The side portion joining portion 56 is formed of a pair of plate bodies which protrudes leftward from a left side surface of the right crawler frame body 55 and is disposed with a gap formed therebetween in the front-rear direction thus allowing the gap to receive the right mounting portion 45. A through hole is formed in each of the pair of plate bodies of the side portion joining portion 56 such that a through hole penetrates the plate body in the front-rear direction. The side portion joining portion 56 is joined to the right mounting portion 45 of the car body 32 by inserting a pin 60 in the through holes formed in the pair of plate bodies of the side portion joining portion 56 and the through hole formed in the right mounting portion 45 in a state where the right mounting portion 45 is inserted between the pair of plate bodies of the side portion joining portion 56. On the other hand, the side portion joining portion 56 can be separated from the right mounting portion 45 by removing the pin 60 from the through holes formed in the side portion joining portion 56 and the through hole formed in the right mounting portion 45. The pin 60 is connected to a piston rod of a hydraulic cylinder 62 which is mounted on a left side surface of the right crawler frame body 55. The pin 60 is inserted into or removed from the through holes formed in the side portion joining portion 56 and the through hole formed in the right mounting portion 45 by advancing or retracting the piston rod by the hydraulic cylinder 62.

The front portion joining portion 57 is a portion which is separably joined to right end joining portions 78 described later of the front side connecting portion 38, and is connected to the front end portion 42*a* of the car body main part 42 (a front end portion of the car body 32) by way of the front side connecting portion 38. The front portion joining portion 57 is provided on a left side surface of the front portion 55*a* of the right crawler frame body 55. The front portion joining portion 57 includes four pin joining portions 64 and two latch portions 66.

Four pin joining portions 64 are portions which are joined to four right end main member joining portions 90 described later of the front side connecting portion 38. Four pin joining portions 64 are provided at four places spaced apart in the vertical direction and in the front-rear direction on a left side surface of the front portion 55*a*. Each of the pin joining portions 64 is a plate-like member which protrudes leftward from the left side surface of the front portion 55*a*, and is disposed such that plate surfaces of the plate member extend along the vertical direction. A through hole is formed in each of the pin joining portions 64 so as to penetrate the pin joining portion 64 in the front-rear direction.

Two latch portions 66 are portions which are joined to two right end sub member connecting portions 92 described later of the front side connecting portion 38. Two latch portions 66 are provided on the left side surface of the front portion 55*a* in a vertically spaced-apart manner. Specifically, one latch portion 66 out of two latch portions 66 is provided at a place between the upper two pin joining portions 64 out of four pin joining portions 64 on the left side surface of the front portion 55*a*. The other latch portion 66 is provided at a place between the lower two pin joining portions 64 out of four pin joining portions 64 on the left side surface of the front portion 55*a*.

Figure 8:
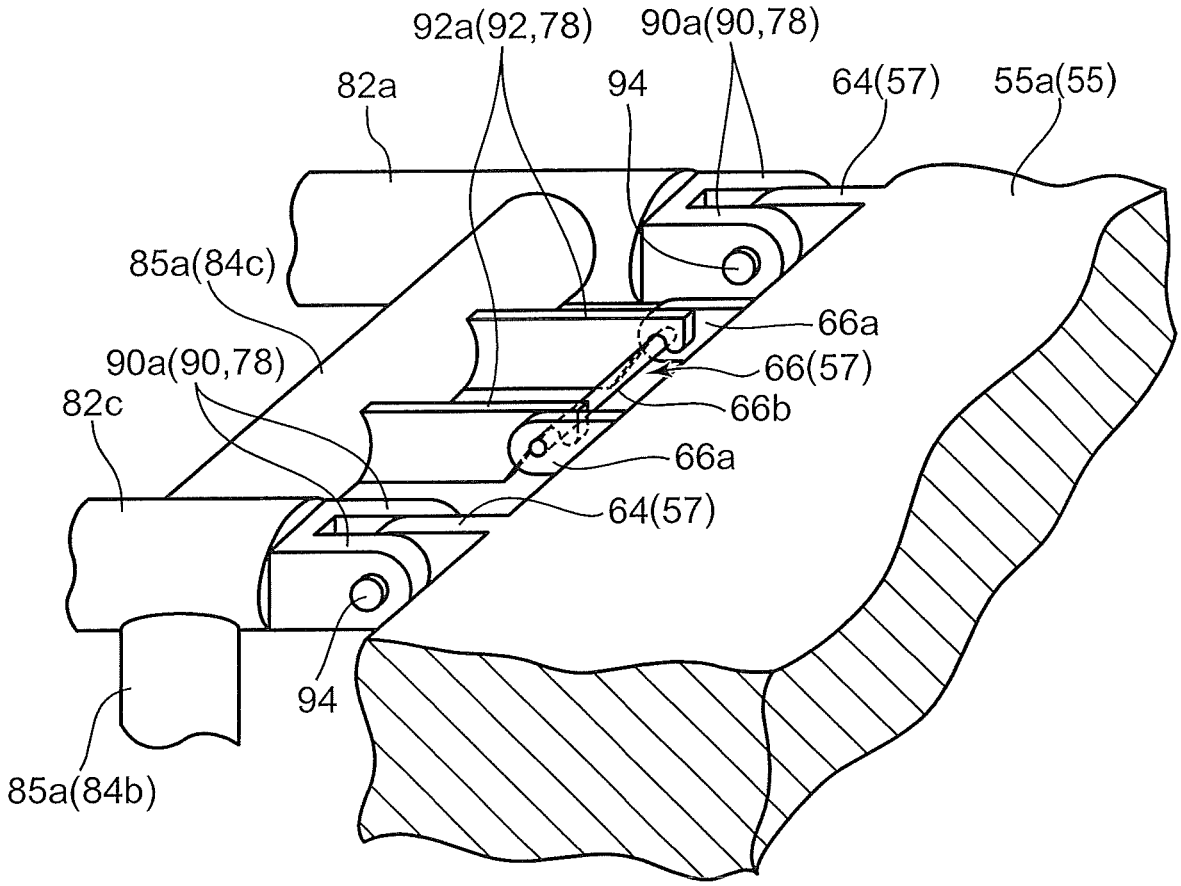
FIG. 8 is a perspective view of the connecting portion between the front side connecting portion and the right crawler frame.
Figure 9:
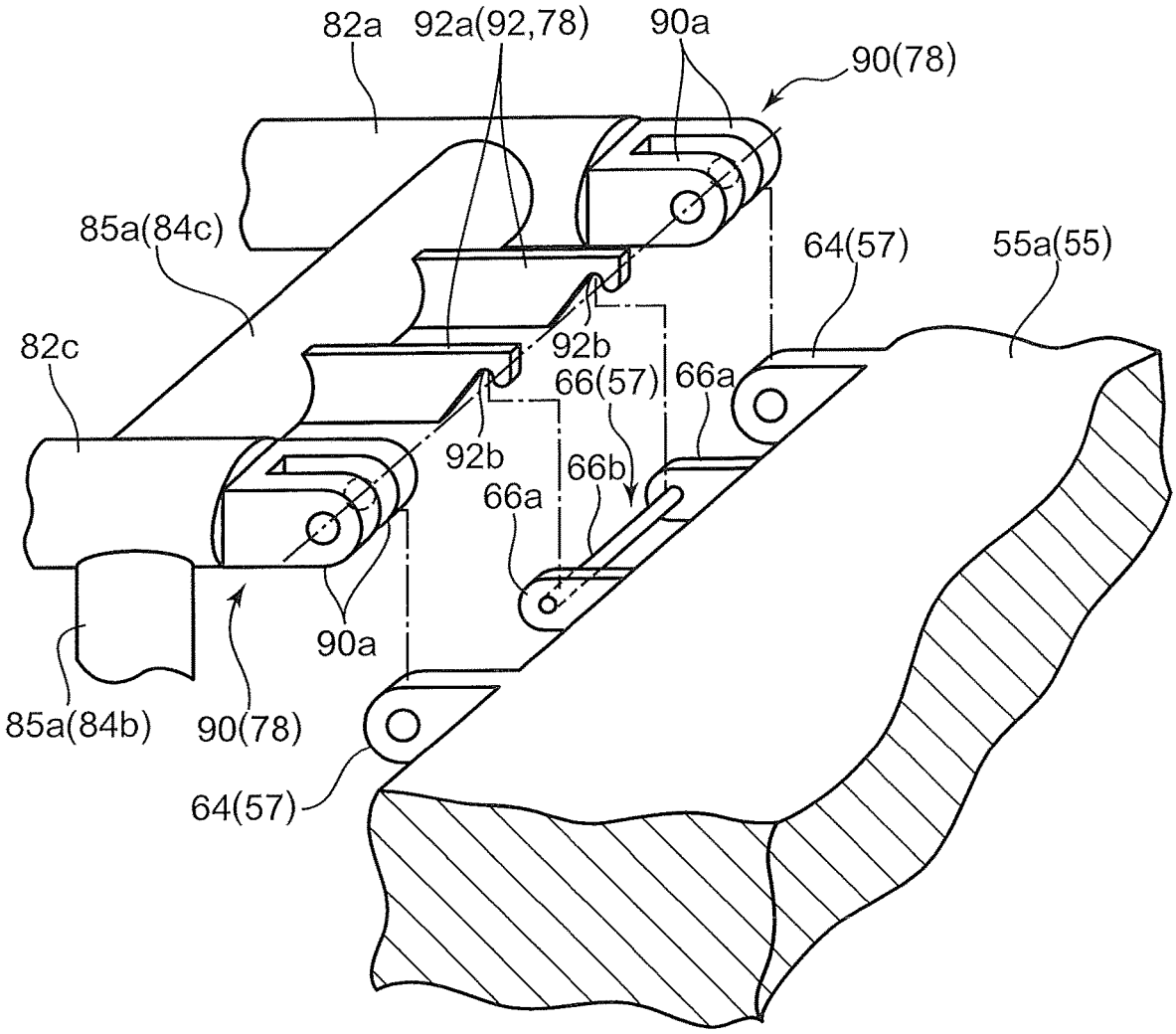
FIG. 9 is an exploded perspective view of the connecting portion shown in FIG. 8.

As shown in FIG. 8 and FIG. 9, each of the latch portions 66 has a pair of base portions 66*a*, and a latch pin 66*b*.

The pair of base portions 66*a* are provided on the left side surface of the front portion 55*a* so as to protrude leftward from the left side surface, and are disposed spaced apart from each other in the front-rear direction.

The latch pin 66*b* is a portion on which hook portions 92*a* of the right end sub member connecting portion 92 described later are latched. The latch pin 66*b* has a circular rod shape extending in the front-rear direction, and is provided to the pair of base portions 66*a* to extend between the pair of base portions 66*a*. The latch pin 66*b* is disposed coaxially with the through holes formed in the pin joining portions 64 disposed on both front and rear sides of the latch pin 66*b*.

The rear portion joining portion 58 (see FIG. 4) is a portion which is separably joined to a right end joining portion 98 described later of the rear side connecting portion 40, and is connected to the rear end portion 42*b* of the car body main part 42 (a rear end portion of the car body 32) by way of the rear side connecting portion 40. The rear portion joining portion 58 is provided on a left side surface of the rear portion 55*b* of the right crawler frame body 55. The rear portion joining portion 58 has a configuration similar to that of the front portion joining portion 57.

The right crawler 53 is disposed so as to surround the right crawler frame body 55 in a state where the right crawler device 34 is viewed from a right side. The right crawler 53 is brought into contact with the ground and performs a circulating motion around the right crawler frame body 55 thus generating a propulsion force toward a front side or toward a rear side.

The right crawler drive unit (not illustrated) is a unit which drives the right crawler 53 such that the right crawler 53 performs the circulating motion as described above. The right crawler drive unit has a drive wheel and a driven wheel which are separately provided on a front end portion and a rear end portion of the right crawler frame body 55, and a rotary drive part which rotates the drive wheel. The right crawler drive unit is configured such that the right crawler 53 stretched between the drive wheel and the driven wheel performs a circulating motion by rotating the drive wheel as described above.

The left crawler device 36 is configured symmetrical with the right crawler device 34 in the left-right direction. Specifically, the left crawler device 36 includes the left crawler frame 68, the left crawler 69, and a left crawler drive unit (not illustrated).

The left crawler frame 68 is a frame which supports the left crawler 69 by way of the drive wheel, the driven wheel, and the like of the left crawler drive unit (not illustrated). The left crawler frame 68 is separably connected to the left end portion of the car body 32, and extends in the front-rear direction. The left crawler frame 68 has a left crawler frame front portion 68*a* which protrudes more frontward than the front end of the car body 32, and a left crawler frame rear portion 68*b* which protrudes more rearward than the rear end of the car body 32.

Specifically, the left crawler frame 68 includes a left crawler frame body 70, a plurality of side portion joining portions 71, a front portion joining portion 72, and a rear portion joining portion 73. The left crawler frame body 70, the side portion joining portions 71, the front portion joining portion 72, and the rear portion joining portion 73 have the configuration obtained by inverting the right crawler frame body 55, the side portion joining portions 56, the front portion joining portion 57 and the rear portion joining portion 58 of the right crawler frame 52 in the left-right direction.

The left crawler frame body 70 has a front portion 70*a* which protrudes and extends more frontward than the front end portion of the car body 32, and a rear portion 70*b* which protrudes and extends more rearward than the rear end portion of the car body 32.

The side portion joining portions 71 are provided on a right side surface of an intermediate portion of the left crawler frame body 70 between the front portion 70*a* and the rear portion 70*b* at two places spaced apart from each other in the front-rear direction. The side portion joining portions 71 at two places are separably joined to the left mounting portions 46 of the car body 32 at the two places. The joining structure between the side portion joining portion 71 and the left mounting portion 46 is similar to the joining structure between the side portion joining portion 56 of the right crawler frame 52 and the right mounting portion 45 of the car body 32.

The front portion joining portion 72 is provided on a right side surface of the front portion 70*a* of the left crawler frame body 70, and the rear portion joining portion 73 is provided on a right side surface of a rear portion 70*b* of the left crawler frame body 70.

The left crawler 69 is disposed so as to surround the left crawler frame body 70 when the left crawler device 36 is viewed from a left side. The left crawler 69 is brought into contact with the ground and performs a circulating motion around the left crawler frame body 70, thus generating a propulsion force toward a front side or toward a rear side. The left crawler 69 has a configuration similar to that of the right crawler 53.

The left crawler drive unit (not illustrated) is a unit which drives the left crawler 69 such that the left crawler 69 performs a circulating motion as described above. The left crawler drive unit has a configuration similar to that of the right crawler drive unit.

The front side connecting portion 38 is separably joined to each of the front end portion of the car body 32, the right crawler frame front portion 52*a* and the left crawler frame front portion 68*a*, and connects the front end portion of the car body 32, the right crawler frame front portion 52*a* and the left crawler frame front portion 68*a* to each other in a state where the front side connecting portion 38 is joined to each of the front end portion of the car body 32, the right crawler frame front portion 52*a* and the left crawler frame front portion 68*a*.

In this embodiment, when the crawler crane 1 has the luffing specification or the crane specification, a portion of the fixing jib 18 which is not used for the attachment 5 is used as the front side connecting portion 38. On the other hand, when the crawler crane 1 has the fixing jib specification, a portion of any one of the luffing jib 10, the front strut 12, and the rear strut 14 which are not used for the attachment 5 is used as the front side connecting portion 38. Specifically, when the crawler crane 1 has the luffing specification or the crane specification, the intermediate jib 18*b* removed from the fixing jib 18 is used as the front side connecting portion 38. Further, when the crawler crane 1 has the fixing jib specification, the intermediate jib 10*b* removed from the luffing jib 10, the intermediate strut 12*b* removed from the front strut 12, or the intermediate strut 14*b* removed from the rear strut 14 is used as the front side connecting portion 38.

In other words, the intermediate jib 18*b* of the fixing jib 18 has a configuration similar to that of the front side connecting portion 38 so that the intermediate jib 18*b* can be used as the front side connecting portion 38. At least one of the intermediate jib 10*b* of the luffing jib 10, the intermediate strut 12*b* of the front strut 12, and the intermediate strut 14*b* of the rear strut 14 has a configuration similar to that of the front side connecting portion 38 such that at least one of the intermediate jib 10*b* of the luffing jib 10, the intermediate strut 12*b* of the front strut 12, and the intermediate strut 14*b* of the rear strut 14 can be used as the front side connecting portion 38.

The front side connecting portion 38 includes a front side lattice portion 76, four intermediate joining portions 77, a right end joining portion 78, and a left end joining portion 79.

The front side lattice portion 76 is disposed between the right crawler frame front portion 52*a*, and the left crawler frame front portion 68*a* and extends in the left-right direction. The whole front side lattice portion 76 has the lattice structure. The front side lattice portion 76 includes: four main members 82 extending in the left-right direction and being arranged parallel to each other; and a plurality of sub members 84 each connecting the main members 82 disposed adjacently to each other among four main members 82.

Figure 6:
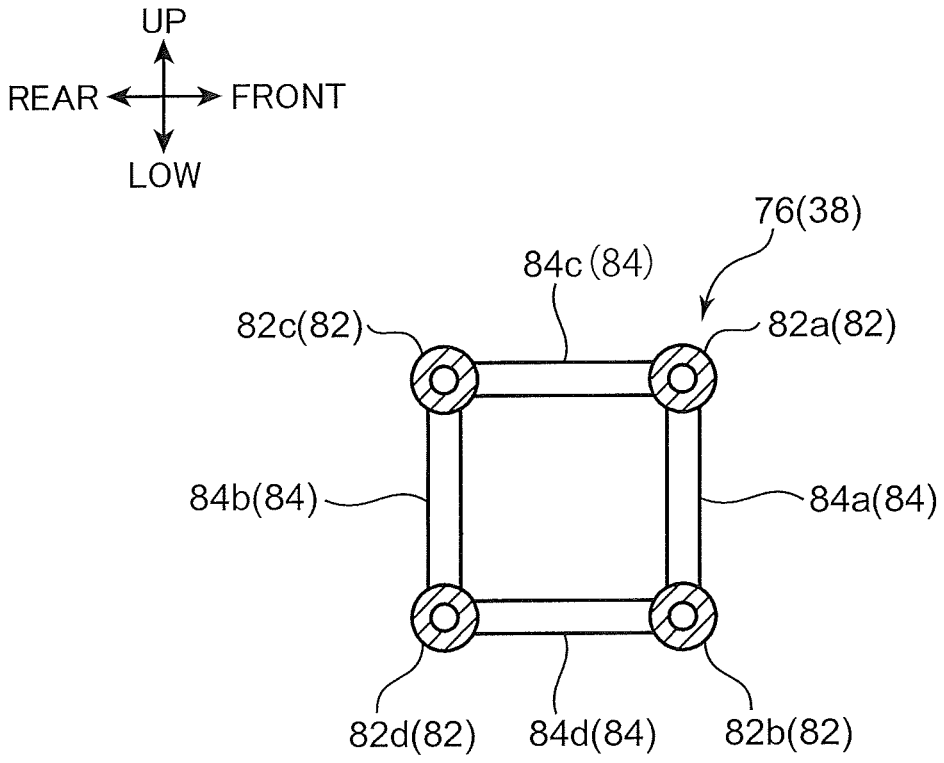
FIG. 6 is a cross-sectional view of a front side lattice portion of a front side connecting portion of the lower traveling body in a direction orthogonal to a longitudinal direction of the front side lattice portion.

As shown in FIG. 6, four main members 82 are each formed of a hollow circular cylindrical pipe, and are disposed at positions corresponding to four vertexes of a square shape in cross section orthogonal to a longitudinal direction (left-right direction) of the front side lattice portion 76. Specifically, four main members 82 are formed of a first upper main member 82*a*, a first lower main member 82*b*, a second upper main member 82*c*, and a second lower main member 82*d*.

The first lower main member 82*b* is disposed directly below the first upper main member 82*a* spaced apart from the first upper main member 82*a*.

The second upper main member 82*c* is disposed behind the first upper main member 82*a* spaced apart from the first upper main member 82*a*. The second lower main member 82*d* is disposed directly below the second upper main member 82*c* spaced apart from the second upper main member 82*c* and is also disposed behind the first lower main member 82*b* spaced apart from the first lower main member 82*b*.

The plurality of sub members 84 are each formed of a hollow circular cylindrical pipe. The plurality of sub members 84 include first vertical connecting sub members 84*a*, second vertical connecting sub members 84*b*, first front-rear connecting sub members 84*c*, and second front-rear connecting sub members 84*d*.

The first vertical connecting sub members 84*a* are disposed between the first upper main member 82*a* and the first lower main member 82*b*, and connect the first upper and lower main members 82*a*, 82*b* to each other.

The second vertical connecting sub members 84*b* are disposed between the second upper main member 82*c* and the second lower main member 82*d*, and connect the second upper and lower main members 82*c*, 82*d* to each other.

The first front-rear connecting sub members 84*c* are disposed between the first upper main member 82*a* and the second upper main member 82*c*, and connect the first and second upper main members 82*a*, 82*c* to each other.

The second front-rear connecting sub members 84*d* are disposed between the first lower main member 82*b* and the second lower main member 82*d*, and connect the first and second lower main members 82*b*, 82*d* to each other.

Figure 5:
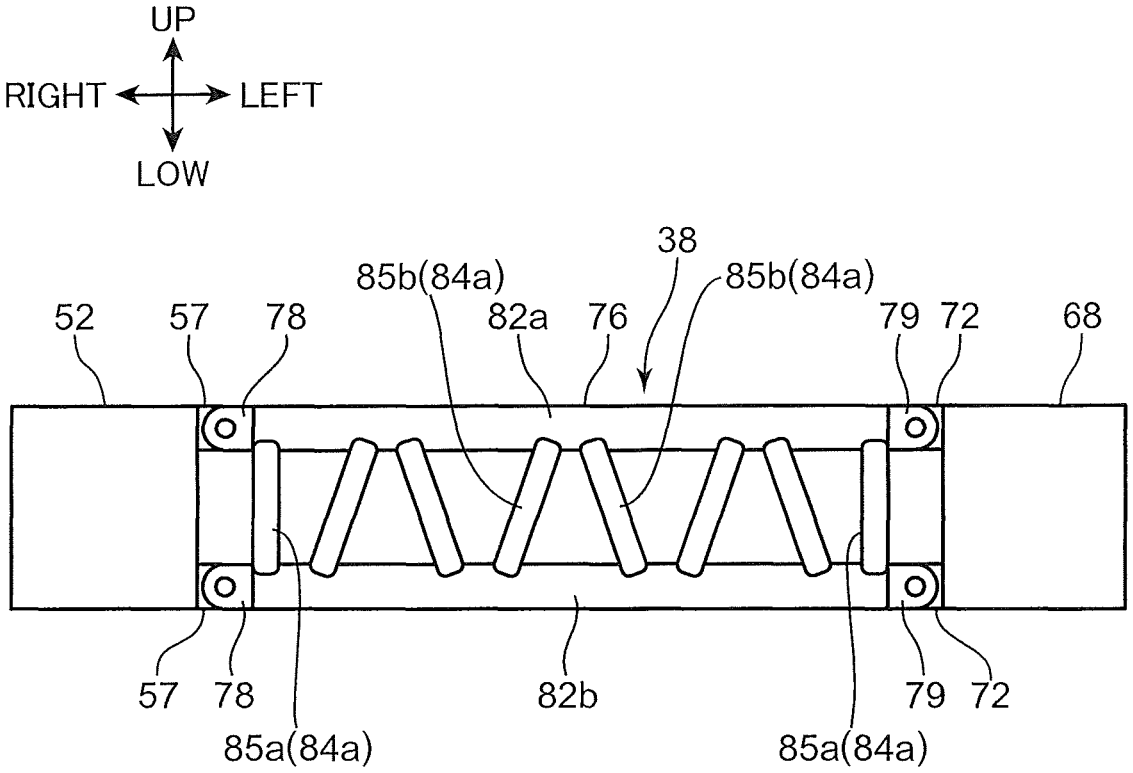
FIG. 5 is a view of the lower traveling body as viewed in a direction from a front side toward a rear side in a state where crawlers are removed from left and right crawler devices, respectively.

The first vertical connecting sub members 84*a*, the second vertical connecting sub members 84*b*, the first front-rear connecting sub members 84*c*, and the second front-rear connecting sub members 84*d* each include two orthogonal members 85*a* (see FIG. 5 and FIG. 7) and a plurality of oblique members 85*b*.

The orthogonal members 85*a* extend in a direction orthogonal to two main members 82 which are connected to each other by these orthogonal members 85*a*. The orthogonal member 85*a* is disposed between portions in the vicinity of one ends (in the vicinity of right ends) of the two main members 82 disposed adjacently to each other and between portions in the vicinity of the other ends (in the vicinity of left ends) of the two main members 82 respectively. The orthogonal member 85*a* which is disposed between the portions in the vicinity of one ends of the two main members 82 disposed adjacently to each other connects the portions in the vicinity of one ends of the two main members 82 to each other, and the orthogonal member 85*a* which is disposed between the portions in the vicinity of the other ends of the two main members 82 disposed adjacently to each other connects the portions in the vicinity of the other ends of the two main members 82 to each other.

The plurality of oblique members 85*b* respectively extend obliquely with respect to two main members 82 which are connected to each other by these oblique members 85*b*, and respectively extend obliquely with respect to the orthogonal members 85*a* which connect the two main members 82 to each other. The plurality of oblique members 85*b* are disposed in a region between the orthogonal member 85*a* disposed in the vicinity of one ends of the two main members 82 and the orthogonal member 85*a* disposed in the vicinity of the other ends of the two main members 82 between the two main members 82 disposed adjacently to each other, and connect the two main members 82 to each other.

Four intermediate joining portions 77 are separably joined to the front end portion of the car body 32, specifically, four front mounting portions 43 at an intermediate portion of the front side connecting portion 38 in a longitudinal direction (left-right direction) of the front side connecting portion 38. Among four intermediate joining portions 77, two intermediate joining portions 77 are provided on a rear surface of the second upper main member 82*c* of the front side lattice portion 76, and the remaining two intermediate joining portions 77 are provided on a rear surface of the second lower main member 82*d* of the front side lattice portion 76. Two intermediate joining portions 77 provided on the rear surface of the second upper main member 82*c* are separately disposed at both positions spaced apart leftward and rightward from the center in the longitudinal direction of the front side lattice portion 76 by an equal distance. Two intermediate joining portions 77 provided on the rear surface of the second lower main member 82*d* are also separately disposed at both positions spaced apart leftward and rightward from the center in the longitudinal direction of the front side lattice portion 76 by an equal distance. The relative positional relationship between four intermediate joining portions 77 corresponds to the relative positional relationship between four front mounting portions 43 of the car body 32.

Figure 7:
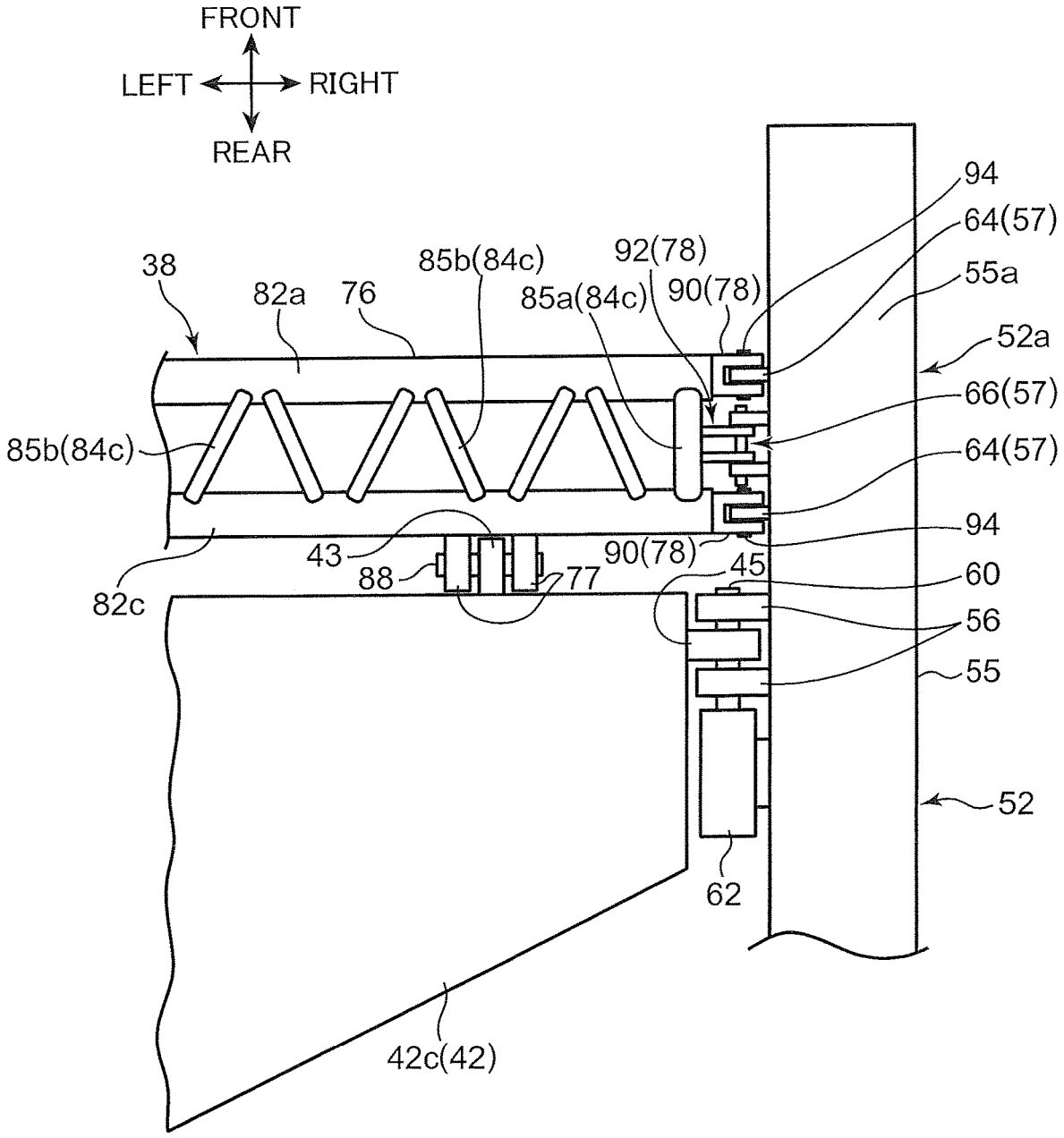
FIG. 7 is a view showing a connecting portion between a car body of the lower traveling body, a right crawler frame and the front side connecting portion shown in FIG. 4 and an area in the vicinity of the connecting portion in a partially enlarged manner.

Each intermediate joining portion 77 is formed of a pair of plate bodies which protrudes rearward from the rear surface of the second upper main member 82*c* or the rear surface of the second lower main member 82*d* on which the intermediate joining portion 77 is provided (see FIG. 7). The pair of plate bodies is disposed such that plate surfaces of the plate bodies extend along the vertical direction. The pair of plate bodies is disposed with a gap, formed therebetween in the left-right direction (a longitudinal direction of the main member 82), which can receive the insertion of the front mounting portion 43 of the car body 32. A through hole is formed in each of the pair of plate bodies such that the through hole penetrates the plate body in the left-right direction. The through holes formed in the plate bodies are disposed coaxially.

Each intermediate joining portion 77 is joined to the front mounting portion 43 by inserting a pin 88 into the through hole formed in the front mounting portion 43 and the respective through holes formed in the pair of plate bodies of the intermediate joining portion 77 in a state where the corresponding front mounting portion 43 of the car body 32 is inserted between the pair of plate bodies of the intermediate joining portion 77. On the other hand, the intermediate joining portion 77 can be separated from the front mounting portion 43 by removing the pin 88 from the through holes formed in the pair of plate bodies of the intermediate joining portion 77 and the through hole formed in the front mounting portion 43.

The right end joining portion 78 is separably joined to the front portion joining portion 57 of the right crawler frame 52. The right end joining portion 78 is provided on a right end of the front side lattice portion 76. Specifically, the right end joining portion 78 includes: four right end main member joining portions 90; and two right end sub member connecting portions 92.

Four right end main member joining portions 90 are respectively provided on right ends of four main members 82 of the front side lattice portion 76. Four right end main member joining portions 90 are joined to four pin joining portions 64 of the front portion joining portion 57 of the right crawler frame 52. Four right end main member joining portions 90 are detachably mounted on four pin joining portions 64 of the front portion joining portion 57. Each right end main member joining portion 90 includes a pair of plate-like portions 90*a* which is disposed parallel to each other in the front-rear direction with a gap formed therebetween, thus allowing the gap to receive the corresponding pin joining portion 64. A through hole is formed in each of the pair of plate-like portions 90*a* such that the through hole penetrates the plate-like portion 90*a* in the front-rear direction. The through holes formed in the pair of plate-like portions 90*a* are disposed coaxially with each other.

Each right end main member joining portion 90 is joined to the pin joining portion 64 of the front portion joining portion 57 by inserting a pin 94 in the through hole formed in the pin joining portion 64 and the respective through holes formed in the pair of plate-like portions 90*a* in a state where the pin joining portion 64 of the front portion joining portion 57 of the right crawler frame 52 is inserted between the pair of plate-like portions 90*a*. On the other hand, the right end main member joining portion 90 can be separated from the pin joining portion 64 of the front portion joining portion 57 by removing the pin 94 from the through holes formed in the pair of plate-like portions 90*a* and the through hole formed in the pin joining portion 64 of the front portion joining portion 57. That is, the right end main member joining portion 90 can be separated from the right crawler frame 52.

Two right end sub member connecting portions 92 are joined to two latch portions 66 of the front portion joining portion 57 of the right crawler frame 52. Two right end sub member connecting portions 92 are provided on the orthogonal member 85*a* as the sub member 84 disposed at the rightmost position among the plurality of sub members 84 which connect two upper main members 82 of the front side lattice portion 76 to each other, and are also provided on the orthogonal member 85*a* as the sub member 84 disposed at the rightmost position among the plurality of sub members 84 which connect two lower main members 82 of the front side lattice portion 76 to each other, respectively.

Each right end sub member connecting portion 92 has a pair of hook portions 92*a* which protrudes rightward from the orthogonal member 85*a* on which the right end sub member connecting portion 92 is provided. The pair of hook portions 92*a* is hooked to the latch pin 66*b* of the corresponding latch portion 66 from above. The pair of hook portions 92*a* is disposed with a gap formed therebetween in the front-rear direction. A distance between the pair of hook portions 92*a* in the front-rear direction is set to a distance that the pair of hook portions 92*a* can be inserted between the pair of base portions 66*a* of the front portion joining portion 57. The right end sub member connecting portion 92 is configured such that, in a state where the pair of hook portions 92*a* of the right end sub member connecting portion 92 is latched to the latch pin 66*b* of the corresponding latch portion 66, the through holes formed in the pair of plate-like portions 90*a* of the right end main member joining portion 90 positioned on both front and rear sides of the right end sub member connecting portion 92 become coaxial with the through holes formed in the pin joining portions 64 of the front portion joining portion 57 of the right crawler frame 52.

Specifically, each hook portion 92*a* has a recessed portion 92*b* (see FIG. 9) which opens downward at a position in the vicinity of a distal end of the hook portion 92*a*. The recessed portion 92*b* is a portion which receives the latch pin 66*b* when each hook portion 92*a* is latched to the latch pin 66*b*. An inner surface of the recessed portion 92*b* on an upper side is curved, and the curved inner surface is fitted on an outer peripheral surface of the latch pin 66*b* when each hook portion 92*a* is latched to the latch pin 66*b*. The curved inner surface is formed into an arc shape having the center on an extension of the center of the through hole formed in each plate-like portion 90*a* of the right end main member joining portion 90. By bringing the outer peripheral surface of the latch pin 66*b* into contact with the curved inner surface of the recessed portion 92*b*, the center of the arc shape of the curved inner surface of the recessed portion 92*b* and an axis of the latch pin 66*b* coincides with each other. As a result, the through hole formed in the pin joining portion 64 which is coaxial with the axis of the latch pin 66*b* and the through holes formed in the respective plate-like portions 90*a* of the right end main member joining portion 90 which are coaxial with the center of the arc shape of the curved inner surface of the recessed portion 92*b* are aligned coaxially with each other.

The left end joining portion 79 is separably joined to the front portion joining portion 72 of the left crawler frame 68. The left end joining portion 79 is provided on a left end of the front side lattice portion 76. The configuration of the left end joining portion 79 can be obtained by inverting the configuration of the right end joining portion 78 in the left-right direction. The joining structure between the left end joining portion 79 and the front portion joining portion 72 of the left crawler frame 68 is similar to the joining structure between the right end joining portion 78 and the front portion joining portion 57 of the right crawler frame 52.

The rear side connecting portion 40 is separably joined to each of the rear end portion of the car body 32, the right crawler frame rear portion 52*b* and the left crawler frame rear portion 68*b*, and connects the rear end portion of the car body 32, the right crawler frame rear portion 52*b* and the left crawler frame rear portion 68*b* to each other in a state where the rear side connecting portion 40 is joined to each of the rear end portion of the car body 32, the right crawler frame rear portion 52*b* and the left crawler frame rear portion 68*b*. The configuration of the rear side connecting portion 40 can be obtained by inverting the configuration of the front side connecting portion 38 in the front-rear direction. The rear side connecting portion 40 includes a rear side lattice portion 96 having the lattice structure, four intermediate joining portions 97, a right end joining portion 98, and a left end joining portion 99.

The rear side lattice portion 96 is disposed between the right crawler frame rear portion 52*b* and the left crawler frame rear portion 68*b* and extends in the left-right direction. The rear side lattice portion 96 includes four main members 100, and a plurality of sub members 101 which are respectively formed similarly to four main members 82 and the plurality of sub members 84 of the front side lattice portion 76 described previously. That is, four main members 100 of the rear side lattice portion 96 includes a first upper main member, a first lower main member, a second upper main member, and a second lower main member which are respectively formed similarly to the first upper main member 82*a*, the first lower main member 82*b*, the second upper main member 82*c*, and the second lower main member 82*d* included in four main members 82 of the front side lattice portion 76. The plurality of sub members 101 of the rear side lattice portion 96 includes first vertical connecting sub members, second vertical connecting sub members, first front-rear connecting sub members, and second front-rear connecting sub members which are respectively formed similarly to the first vertical connecting sub members 84*a*, the second vertical connecting sub members 84*b*, the first front-rear connecting sub members 84*c*, and the second front-rear connecting sub members 84*d* included in the plurality of sub members 84 of the front side lattice portion 76.

Four intermediate joining portion 97 are separably joined to the rear end portion of the car body 32, specifically, four rear mounting portions 44 at an intermediate portion of the rear side connecting portion 40 in the longitudinal direction of the rear side connecting portion 40 (in the left-right direction). Out of four intermediate joining portions 97, two intermediate joining portions 97 are provided on a front surface of the front upper main member 100 of the rear side lattice portion 96, and remaining two intermediate joining portions 97 are provided on a front surface of the front lower main member 100 of the rear side lattice portion 96. Four intermediate joining portions 97 have configurations similar to those of four intermediate joining portions 77 of the front side connecting portion 38. The joining structure between four intermediate joining portions 97 and four rear mounting portions 44 is similar to the joining structure between four intermediate joining portions 77 of the front side connecting portion 38 and four front mounting portions 43.

The right end joining portion 98 is separably joined to the rear portion joining portion 58 of the right crawler frame 52. The right end joining portion 98 has a configuration similar to that of the right end joining portion 78 of the front side connecting portion 38. The right end joining portion 98 is provided on a right end of the rear side lattice portion 96, similarly to the configuration in which the right end joining portion 78 of the front side connecting portion 38 is provided on the right end of the front side lattice portion 76. The joining structure between the right end joining portion 98 and the rear portion joining portion 58 of the right crawler frame 52 is similar to the joining structure between the right end joining portion 78 of the front side connecting portion 38 and the front portion joining portion 57 of the right crawler frame 52.

The left end joining portion 99 is separably joined to the rear portion joining portion 73 of the left crawler frame 68. The left end joining portion 99 has a configuration similar to that of the left end joining portion 79 of the front side connecting portion 38. The left end joining portion 99 is provided on a left end of the rear side lattice portion 96, similarly to the configuration in which the left end joining portion 79 of the front side connecting portion 38 is provided on the left end of the front side lattice portion 76. The joining structure between the left end joining portion 99 and the rear portion joining portion 73 of the left crawler frame 68 is similar to the joining structure between the left end joining portion 79 of the front side connecting portion 38 and the front portion joining portion 72 of the left crawler frame 68.

In the crawler crane 1 according to this embodiment, the front end portion of the car body 32, the right crawler frame front portion 52*a*, and the left crawler frame front portion 68*a* are connected to each other by the front side connecting portion 38 having the front side lattice portion 76. Further, the rear end portion of the car body 32, the right crawler frame rear portion 52*b* and the left crawler frame rear portion 68*b* are connected to each other by the rear side connecting portion 40 having the rear side lattice portion 96. Accordingly, while suppressing the increase in weight attributed to the front side connecting portion 38 and the rear side connecting portion 40, the degree of stability of the crawler crane 1 against falling of the crawler crane 1 in the front-rear direction can be enhanced, thus enhancing hanging ability of the crawler crane 1.

Specifically, in the crawler crane 1 according to this embodiment, the front end portion of the car body 32, and the right crawler frame front portion 52*a* and the left crawler frame front portion 68*a* which protrude more frontward than the front end of the car body 32 are connected to each other by the front side connecting portion 38 which is separated from the car body 32. The rear end portion of the car body 32, and the right crawler frame rear portion 52*b* and the left crawler frame rear portion 68*b* which protrude more rearward than the rear end of the ear body are also connected to each other by the rear side connecting portion 40 which is separated from the car body 32. Accordingly, compared to a case where left and right crawler frames are connected to a car body only at positions between a front end and a rear end of the car body, the left and right crawler frames 52, 68 can be connected to the car body 32 at positions closer to front ends of the left and right crawler frames 52, 68 and at positions closer to rear ends of the left and right crawler frames 52, 68, respectively. Accordingly, deflection amounts in the vertical direction of the right crawler frame front portion 52*a*, the left crawler frame front portion 68*a*, the right crawler frame rear portion 52*b* and the left crawler frame rear portion 68*b* can be reduced so that it is possible to enhance the degree of stability of the crawler crane 1 against falling of the crawler crane 1 in the front-rear direction. As a result, hanging ability of the crawler crane 1 can be enhanced.

In the crawler crane 1 according to this embodiment, the front side connecting portion 38 is separably joined to each of the front end portion of the car body 32, the right crawler frame front portion 52*a*, and the left crawler frame front portion 68*a*. The rear side connecting portion 40 is separably joined to each of the rear end portion of the car body 32, the right crawler frame rear portion 52*b*, and the left crawler frame rear portion 68*b*. Further, the right crawler frame 52 is separably joined to the right end portion of the car body 32, and the left crawler frame 68 is separably joined to the left end portion of the car body 32. Accordingly, at the time of transporting the lower traveling body 3, the front side connecting portion 38 and the rear side connecting portion 40 are removed from the car body 32 and the left and right crawler frames 52, 68, the left and right crawler frames 52, 68 are removed from the car body 32. Accordingly, the crawler crane 1 can be formed into the car body 32 as a single unit and hence, it is possible to overcome the restriction in sizes and weight imposed on the crawler crane 1 at the time of transporting the crawler crane 1 on a public road.

In the crawler crane 1 according to this embodiment, the front side connecting portion 38 has the front side lattice portion 76 having the lattice structure, and the rear side connecting portion 40 has the rear side lattice portion 96 having the lattice structure. Accordingly, the degree of stability of the crawler crane 1 against falling of the crawler crane 1 in the front-rear direction can be enhanced while suppressing the increase in weight attributed to the front side connecting portion 38 and the rear side connecting portion 40. Further, since the increase in weight attributed to the front side connecting portion 38 and the rear side connecting portion 40 can be suppressed, the increase in ground contact pressure of the right crawler 53 and the increase in ground contact pressure of the left crawler 69 can be reduced. As a result, an advantageous effect can be obtained in which it is possible to suppress the increase in cost necessary for enlarging a width of a crawler shoe, ground curing, and the like, for example, which are taken as countermeasures against the increase in ground contact pressure.

In the crawler crane 1 according to this embodiment, it is possible to form the lattice structure which can effectively cope with the deflection of the right crawler frame front portion 52*a* and the left crawler frame front portion 68*a* in the vertical direction. The lattice structure is formed of the first upper main member 82*a*, the first lower main member 82*b*, the first vertical connecting sub members 84*a* which connect the main members 82*c*, 82*d* to each other between the main members 82*c*, 82*d*, the second upper main member 82*c*, the second lower main member 82*d*, and the second vertical connecting sub members 84*b* which connect the main members 82*c*, 82*d* to each other between the main members 82*c*, 82*d* which form the front side lattice portion 76. Also, in the rear side lattice portion 96, it is possible to form the lattice structure which can effectively cope with the deflection in the vertical direction of the right crawler frame rear portion 52*b* and the left crawler frame rear portion 68*b* by the similar configuration. Accordingly, the deflection amounts in the vertical direction of the right crawler frame front portion 52*a*, the left crawler frame front portion 68*a*, the right crawler frame rear portion 52*b*, and the left crawler frame rear portion 68*b* can be effectively reduced.

In this embodiment, the front side connecting portion 38 is joined to the right crawler frame front portion 52*a* by the right end joining portion 78 at two places spaced apart in the vertical direction, and is joined to the left crawler frame front portion 68*a* by the left end joining portion 79 at two places spaced apart in the vertical direction. The rear side connecting portion 40 is joined to the right crawler frame rear portion 52*b* by the right end joining portion 98 at two places spaced apart in the vertical direction, and is joined to the left crawler frame rear portion 68*b* by the left end joining portion 99 at two places which are spaced apart in the vertical direction.

Due to various factors such as, for example, a balance of a hanging load hung by the hanging tool 15 of the attachment 5 and an inclination of a ground surface when the upper slewing body 2 faces a front side or a rear side of the lower traveling body 3 or a weight of a load when the upper slewing body 2 faces a right side or a left side of the lower traveling body 3, a force which causes a lateral deflection may act on the lower traveling body 3 so that one side of the lower traveling body 3 in the left-right direction is displaced upward or downward with respect to the other side of the lower traveling body 3. On the other hand, according to the configuration of this embodiment, with respect to the right crawler frame front portion 52*a* and the left crawler frame front portion 68*a*, the defection which makes one frame portion displace upward or downward with respect to the other frame portion can be suppressed by two joining portions of the front side connecting portion 38 to the right crawler frame front portion 52*a* at two upper and lower places and by two joining portions of the front side connecting portion 38 to the left crawler frame front portion 68*a* at two upper and lower places. On the other hand, with respect to the right crawler frame rear portion 52*b* and the left crawler frame rear portion 68*b*, the defection which makes one frame portion displace upward or downward with respect to the other frame portion can be suppressed by two joining portions of the rear side connecting portion 40 to the right crawler frame rear portion 52*b* at two upper and lower places and by two joining portions of the rear side connecting portion 40 to the left crawler frame rear portion 68*b* at two upper and lower places. Accordingly, the lateral deflection as described above can be suppressed.

In this embodiment, the first upper main member 82*a*, the first lower main member 82*b*, the second upper main member 82*c*, and the second lower main member 82*d* are disposed at respective positions corresponding to four vertexes of a square shape. The first upper main member 82*a* and the first lower main member 82*b* disposed adjacently to each other in the vertical direction are connected to each other by the first vertical connecting sub members 84*a* disposed between the first upper main member 82*a* and the first lower main member 82*b*. The second upper main member 82*c* and the second lower main member 82*d* disposed adjacently to each other in the vertical direction are connected to each other by the second vertical connecting sub members 84*b* disposed between the second upper main member 82*c* and the second lower main member 82*d*. The first upper main member 82*a* and the second upper main member 82*c* disposed adjacently to each other in the front-rear direction are connected to each other by the first front-rear connecting sub members 84*c* disposed between the first upper main member 82*a* and the second upper main member 82*c*. The first lower main member 82*b* and the second lower main member 82*d* disposed adjacently to each other in the front-rear direction are connected to each other by the second front-rear connecting sub members 84*d* disposed between the first lower main member 82*b* and the second lower main member 82*d*. Accordingly, it is possible to provide the front side lattice portion 76 with the structure which can further strongly resist the deflection of the right crawler frame front portion 52*a* and the left crawler frame front portion 68*a* in the vertical direction. It is also possible to provide the rear side lattice portion 96 with the structure which can further strongly resist the deflection of the right crawler frame rear portion 52*b* and the left crawler frame rear portion 68*b* in the vertical direction. As a result, deflection amounts of the right crawler frame front portion 52*a*, the left crawler frame front portion 68*a*, the right crawler frame rear portion 52*b*, and the left crawler frame rear portion 68*b* in the vertical direction can be further reduced.

In the crawler crane 1 according to this embodiment, at least one of the intermediate jib 10*b* of the luffing jib 10, the intermediate strut 12*b* of the front strut 12, and the intermediate strut 14*b* of the rear strut 14 and the intermediate jib 18*b* of the fixing jib 18 have structures similar to those of the front side connecting portion 38 and the rear side connecting portion 40. Accordingly, among the luffing jib 10, the front strut 12, the rear strut 14 and the fixing jib 18, from the member which is not mounted on the distal end portion of the boom 8 due to a hanging operation mode (the specification of the crawler crane 1), the intermediate jib 10*b*, the intermediate strut 12*b*, the intermediate strut 14*b* or the intermediate jib 18*b* can be separated and used as the front side connecting portion 38 and the rear side connecting portion 40. Accordingly, it is unnecessary to additionally prepare the front side connecting portion 38 and the rear side connecting portion 40, thus reducing the number of parts.

The crawler crane according to the present invention is not always limited to the crawler crane having the above-mentioned configuration. For example, the crawler crane according to the present invention may adopt the following configurations.

Figure 10:
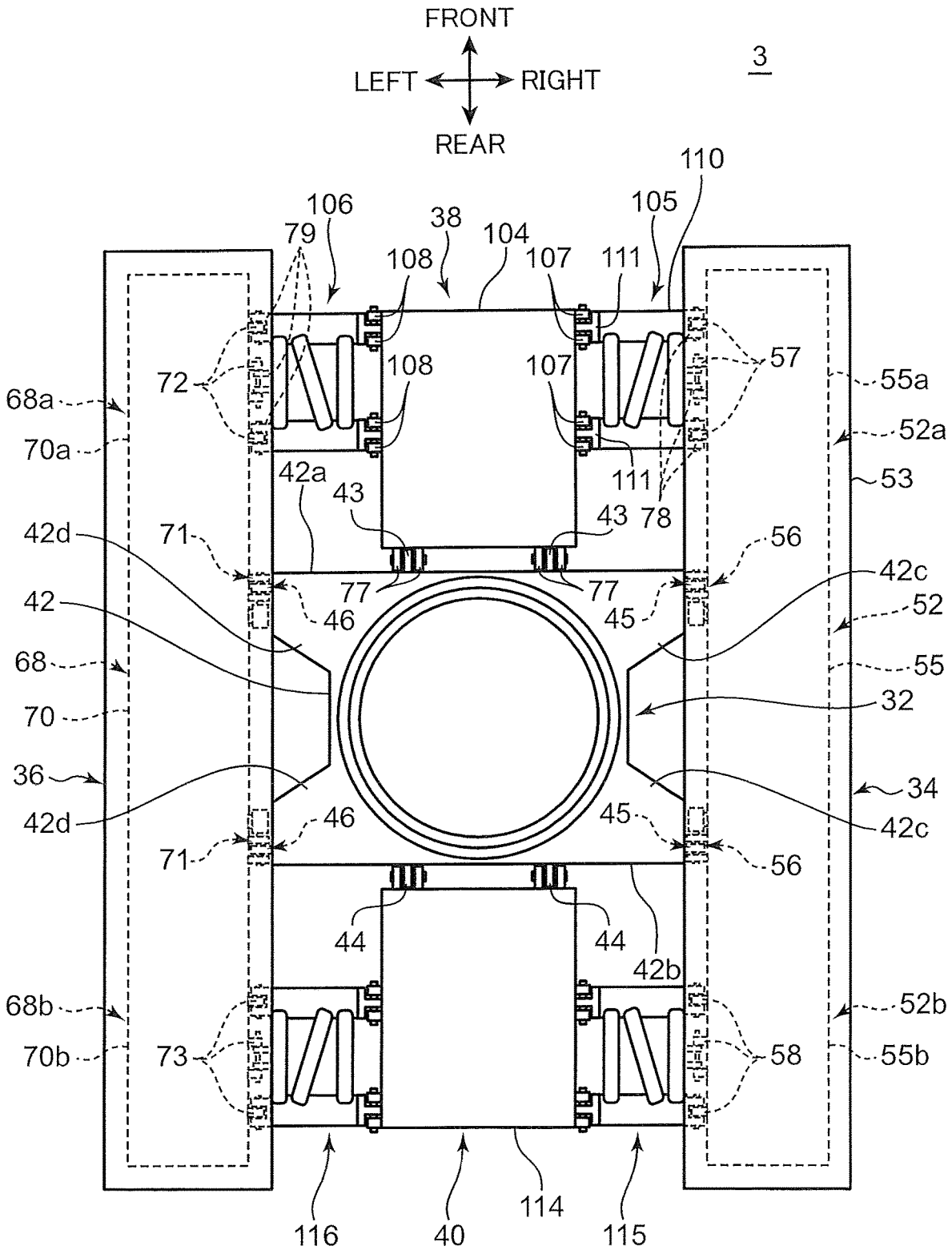
FIG. 10 is a view showing only a lower traveling body of a crawler crane according to one modification of the present invention as viewed from above.
Figure 11:
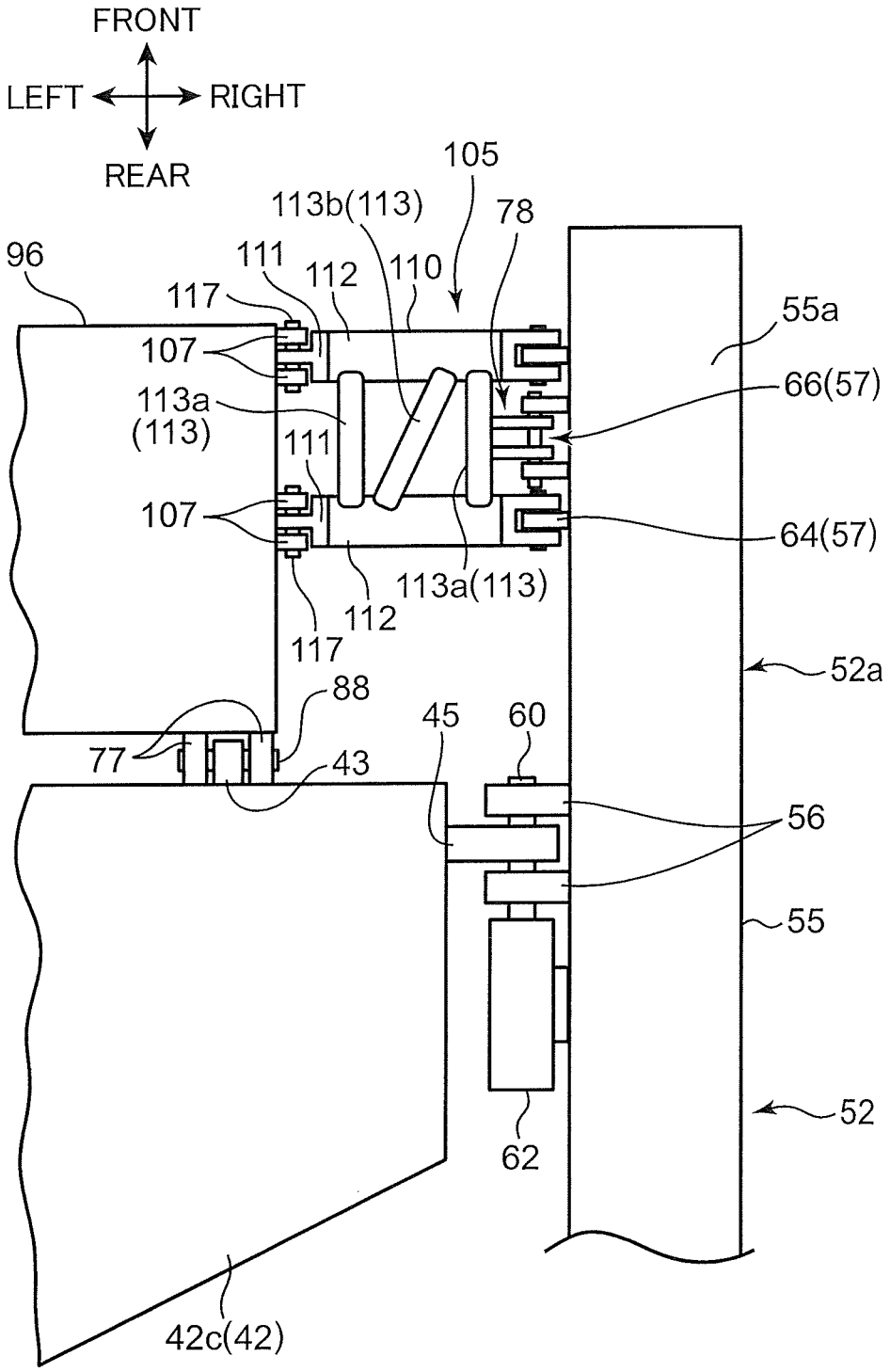
FIG. 11 is a view showing a connecting portion between the car body of the lower traveling body shown in FIG. 10, a right crawler frame, and a front side connecting portion and an area in the vicinity of the connecting portion in a partially enlarged manner.

A front side connecting portion and a rear side connecting portion may partially include a portion which does not have the lattice structure. For example, the front side connecting portion and the rear side connecting portion may be respectively configured by combining a car body weight and a lattice portion to each other. FIG. 10 and FIG. 11 show a lower traveling body 3 according to a modification having such a configuration.

A front side connecting portion 38 of the lower traveling body 3 according to the modification includes a front side car body weight 104, a front right side lattice portion 105, and a front left side lattice portion 106.

The front side car body weight 104 is a weight which is mounted on a front end portion of the car body 32 for enhancing the degree of stability against falling of the crawler crane 1 in the front-rear direction. The front side car body weight 104 is formed of a metal plate having a rectangular shape as viewed from above. The front side car body weight 104 is disposed in front of the car body 32 and between the right crawler frame front portion 52*a* and the left crawler frame front portion 68*a*. A gap is formed between the front side car body weight 104 and a right crawler frame front portion 52*a* in the left-right direction, and a gap is formed between the front side car body weight 104 and a left crawler frame front portion 68*a* in the left-right direction.

The front side car body weight 104 includes four intermediate joining portions 77 which are provided on a rear end portion of the front side car body weight 104. Four intermediate joining portions 77 are formed similarly to four intermediate joining portions 77 which are provided on the front side lattice portion 76 of the above-mentioned embodiment. By joining four intermediate joining portions 77 to four front mounting portions 43 of the car body 32, the front side car body weight 104 is mounted on the front end portion of the car body 32.

The front side car body weight 104 includes four weight right joining portions 107 provided on a right end portion of the front side car body weight 104, and four weight left joining portions 108 provided on a left end portion of the front side car body weight 104.

Four weight right joining portions 107 are disposed spaced apart in the vertical direction and in the front-rear direction on the right end portion of the front side car body weight 104. Each weight right joining portion 107 is formed of a pair of plate-like members which is disposed with a gap formed therebetween in the front-rear direction. A through hole is formed in each of the pair of plate-like members of each weight right joining portion 107. The through hole penetrates the respective plate-like members in the front-rear direction.

Four weight left joining portions 108 are disposed on the left end portion of the front side car body weight 104 such that four weight left joining portions 108 have the symmetrical relationship with four weight right joining portions 107 in the left-right direction. Each weight left joining portion 108 has a configuration similar to that of the weight right joining portion 107.

The front right side lattice portion 105 is disposed between the right crawler frame front portion 52*a* and the right end portion of the front side car body weight 104. The front right side lattice portion 105 connects the right crawler frame front portion 52*a* and the right end portion of the front side car body weight 104 to each other. The front right side lattice portion 105 includes a front right side lattice portion body 110, a right end joining portion 78, and four left end joining portions 111.

The front right side lattice portion body 110 extends in the left-right direction, and the whole front right side lattice portion body 110 has the lattice structure. Specifically, the front right side lattice portion body 110 includes four main members 112 which extend in the left-right direction and are arranged spaced apart in the vertical direction and in the front-rear direction similarly to four main members 82 of the front side lattice portion 76 of the above-mentioned embodiment. The front right side lattice portion body 110 includes a plurality of sub members 113 which interconnect the main members 112 disposed adjacently to each other among four main members 112. The main members 112 and the sub members 113 are respectively formed of a hollow circular cylindrical pipe.

The plurality of sub members 113 include orthogonal members 113*a* and oblique members 113*b*. The orthogonal members 113*a* are provided for connecting portions of the main members 112 disposed adjacently to each other in the vicinity of right ends of the main members 112 and for connecting portions of the main members 112 disposed adjacently to each other in the vicinity of left ends of the main members 112. The orthogonal members 113*a* extend in a direction orthogonal to the main members 112. Between the orthogonal member 113*a* which connects the portions of the main members 112 disposed adjacently to each other in the vicinity of the right ends of the main members 112 and the orthogonal member 113*a* which connects portions of the main members 112 to each other in the vicinity of the left ends of the main members 112, the oblique members 113*b* extend obliquely with respect to the main members 112 and the orthogonal members 113*a* and connect the main members 112 disposed adjacently to each other.

A right end joining portion 78 is provided on the right end portion of the front right side lattice portion body 110. The right end joining portion 78 is formed similarly to the right end joining portion 78 of the above-mentioned embodiment, and is separably joined to a front portion joining portion 57 of a right crawler frame 52.

Four left end joining portions 111 are separably joined to four weight right joining portions 107 of the front side car body weight 104, respectively. The left end joining portions 111 are respectively provided on left ends of four main members 112 of the front right side lattice portion body 110. Each left end joining portion 111 has a plate-like portion which is inserted between a pair of plate-like members of the corresponding weight right joining portion 107, and a through hole is formed in the respective plate like portions so as to penetrate the respective plate-like portions in the front-rear direction. By inserting a pin 117 into the through hole formed in the left end joining portion 111 and through holes formed in the weight right joining portion 107 in a state where the plate-like portion of the left end joining portion 111 is inserted between the pair of plate-like members of the weight right joining portion 107 to which the plate-like portions of the left end joining portion 111 corresponds, the left end joining portion 111 and the weight right joining portion 107 are joined to each other.

The front left side lattice portion 106 is disposed between the left crawler frame front portion 68*a* and the left end portion of the car body weight 104. The front left side lattice portion 106 connects the left crawler frame front portion 68*a* and the left end portion of the front side car body weight 104 to each other. The front left side lattice portion 106 has the symmetrical relationship with the front right side lattice portion 105 in the left-right direction. The front left side lattice portion 106 is joined to the weight left joining portion 108 with a joining structure similar to the joining structure of the right side lattice portion 105 to the weight right joining portion 107. The front left side lattice portion 106 is also joined to the front portion joining portion 72 of the left crawler frame 68 with the joining structure similar to the joining structure of the right side lattice portion 105 to the front portion joining portion 57 of the right crawler frame 52.

The rear side connecting portion 40 of the lower traveling body 3 according to this modification includes a rear side car body weight 114, a rear right side lattice portion 115, and the rear left side lattice portion 116.

The rear side car body weight 114 is a weight mounted on a rear end portion of the car body 32 for enhancing the degree of stability against falling of the crawler crane 1 in the front-rear direction. The configuration of the rear side car body weight 114 can be obtained by inverting the configuration of the front side car body weight 104 in the front-rear direction.

The rear right side lattice portion 115 is disposed between the right crawler frame rear portion 52*b* and a right end portion of the rear side car body weight 114. The rear right side lattice portion 115 connects the right crawler frame rear portion 52*b* and the right end portion of the rear side car body weight 114 to each other. The configuration of the rear right side lattice portion 115 is similar to the configuration of the front right side lattice portion 105.

The rear left side lattice portion 116 is disposed between the left crawler frame rear portion 68*b* and the left end portion of the rear side car body weight 114. The rear left side lattice portion 116 connects the left crawler frame rear portion 68*b* and the left end portion of the rear side car body weight 114 to each other. The configuration of the rear left side lattice portion 116 is similar to the configuration of the front left side lattice portion 106.

The lattice portions of the front side connecting portion and the rear side connecting portion of the present invention may be prepared separately from an attachment for a hanging operation.

Summary of Embodiment and Modification

The embodiment and the modification are summarized as follows.

The crawler crane according to the embodiment and the modification includes: the crawler-type lower traveling body which is capable of self-traveling; and the upper slewing body which is mounted on the lower traveling body in a slewable manner about the slewing axis which extends in the vertical direction. The lower traveling body includes: the car body which supports the upper slewing body from below so that the upper slewing body is slewable, the right crawler device and the left crawler device which are separately disposed on a right side and a left side of the car body and enable traveling of the lower traveling body, the front side connecting portion which interconnects the front end portion of the car body, the right crawler device and the left crawler device; and the rear side connecting portion which interconnects the rear end portion of the car body, the right crawler device and the left crawler device. The right crawler device includes the right crawler frame which is separably connected to the right end portion of the car body and extends in the front-rear direction, and the right crawler which is disposed so as to surround the right crawler frame and is brought into contact with a ground and performs a circulating motion to generate a propulsion force toward a front side or toward a rear side. The left crawler device includes the left crawler frame which is separably connected to the left end portion of the car body and extends in the front-rear direction, and the left crawler which is disposed so as to surround the left crawler frame and is brought into contact with the ground and performs a circulating motion to generate a propulsion force toward a front side or toward a rear side. The right crawler frame has the right crawler frame front portion which protrudes more frontward than the front end of the car body, and the right crawler frame rear portion which protrudes more rearward than the rear end of the car body. The left crawler frame has the left crawler frame front portion which protrudes more frontward than the front end of the car body, and the left crawler frame rear portion which protrudes more rearward than the rear end of the car body. The front side connecting portion is separably joined to each of the front end portion of the car body, the right crawler frame front portion and the left crawler frame front portion, the front side connecting portion configured to interconnect the front end portion of the car body, the right crawler frame front portion and the left crawler frame front portion in a state where the front side connecting portion is joined to each of the front end portion of the car body, the right crawler frame front portion and the left crawler frame front portion. The rear side connecting portion is separably joined to each of the rear end portion of the car body, the right crawler frame rear portion and the left crawler frame rear portion, the rear side connecting portion configured to interconnect the rear end portion of the car body, the right crawler frame rear portion and the left crawler frame rear portion in a state where the rear side connecting portion is joined to each of the rear end portion of the car body, the right crawler frame rear portion and the left crawler frame rear portion. Each of the front side connecting portion and the rear side connecting portion includes the lattice portion which has the lattice structure.

In this crawler crane, the front end portion of the car body, the right crawler frame front portion and the left crawler frame front portion are connected to each other by the front side connecting portion including the lattice portion. Further, the rear end portion of the car body, the right crawler frame rear portion and the left crawler frame rear portion are connected to each other by the rear side connecting portion including the lattice portion. Accordingly, while suppressing the increase in weight attributed to the front side connecting portion and the rear side connecting portion, the degree of stability of the crawler crane against falling of the crawler crane in the front-rear direction can be enhanced thus enhancing hanging ability of the crawler crane.

Specifically, the front end portion of the car body, and the right crawler frame front portion and the left crawler frame front portion which protrude more frontward than the front end of the car body are connected to each other by the front side connecting portion which is separated from the car body. The rear end portion of the car body, and the right crawler frame rear portion and the left crawler frame rear portion which protrude more rearward than the rear end of the car body are connected to each other by the rear side connecting portion which is separated from the car body. Accordingly, compared to a case where left and right crawler frames are connected to a car body only at positions between a front end and a rear end of the car body, the left and right crawler frames can be connected to the car body at positions closer to front ends of the left and right crawler frames and at positions closer to rear ends of the left and right crawler frames, respectively. Accordingly, deflection amounts in the vertical direction of the right crawler frame front portion, the left crawler frame front portion, the right crawler frame rear portion, and the left crawler frame rear portion can be reduced so that it is possible to enhance the degree of stability of the crawler crane against falling of the crawler crane in the front-rear direction. As a result, hanging ability of the crawler crane can be enhanced.

Further, in the crawler crane, the front side connecting portion is separably joined to each of the front end portion of the car body, the right crawler frame front portion, and the left crawler frame front portion. The rear side connecting portion is separably joined to each of the rear end portion of the car body, the right crawler frame rear portion, and the left crawler frame rear portion. Further, the right crawler frame is separably joined to the right end portion of the car body, and the left crawler frame is separably joined to the left end portion of the car body. Accordingly, at the time of transporting the lower traveling body, the front side connecting portion and the rear side connecting portion are removed from the car body and the left and right crawler frames, the left and right crawler frames are removed from the car body. Accordingly, the crawler crane can be formed into the car body as a single unit and hence, it is possible to overcome the restriction in sizes and weight imposed on the crawler crane at the time of transporting the crawler crane on a public road.

Moreover, in the crawler crane, each of the front side connecting portion and the rear side connecting portion includes the lattice portion having the lattice structure. Therefore, the degree of stability of the crawler crane against falling of the crawler crane in the front-rear direction can be enhanced while suppressing the increase in weight attributed to the front side connecting portion and the rear side connecting portion.

It is preferable that the lattice portions of each of the front side connecting portion and the rear side connecting portion includes: a plurality of main members which extend in the left-right direction and are arranged parallel to each other; and a plurality of sub members each interconnecting the main members disposed adjacently to each other among the plurality of main members, the plurality of main members include: a first upper main member; and a first lower main member which is positioned below the first upper main member, and the plurality of sub members include a plurality of first vertical connecting sub members which are arranged at intervals along both a longitudinal direction of the first upper main member and a longitudinal direction of the first lower main member between the first upper main member and the first lower main member, the first vertical connecting sub members connecting the first upper main member and the first lower main member to each other.

With such a configuration, due to the first upper main member, the first lower main member, and the first vertical connecting sub members for connecting the main members to each other between the main members which form the lattice portion of the front side connecting portion, it is possible to form a lattice structure which can effectively resist the deflection of the right crawler frame front portion and the left crawler frame front portion in a vertical direction. Further, due to the first upper main member, the first lower main member, and the first vertical connecting sub members for connecting the main members to each other between the main members which form the lattice portion of the rear side connecting portion, it is possible to form a lattice structure which can effectively resist deflection of the right crawler frame rear portion and the left crawler frame rear portion in the vertical direction. Accordingly, deflection amounts of the right crawler frame front portion, the left crawler frame front portion, the right crawler frame rear portion, and the left crawler frame rear portion in the vertical direction can be effectively reduced.

It is preferable that the first lower main member is disposed below the first upper main member, the plurality of main members further include: a second upper main member which is disposed on one side of the first upper main member in the front-rear direction; and a second lower main member which is disposed on the one side of the first lower main member and is disposed below the second upper main member, and the plurality of sub members further include: a plurality of second vertical connecting sub members which are arranged at intervals along both a longitudinal direction of the second upper main member and a longitudinal direction of the second lower main member between the second upper main member and the second lower main member, the second vertical connecting sub members connecting the second upper main member and the second lower main member to each other; a plurality of first front-rear connecting sub members which are arranged at intervals along both the longitudinal direction of the first upper main member and the longitudinal direction of the second upper main member between the first upper main member and the second upper main member, the first front-rear connecting sub members connecting the first upper main member and the second upper main member to each other; and a plurality of second front-rear connecting sub members which are arranged at intervals along both the longitudinal direction of the first lower main member and the longitudinal direction of the second lower main member between the first lower main member and the second lower main member, the second front-rear connecting sub members connecting the first lower main member and the second lower main member to each other.

With such a configuration, the first upper main member, the first lower main member, the second upper main member, and the second lower main member are disposed at respective positions corresponding to four vertexes of a square shape. The first upper main member and the first lower main member which are disposed adjacently to each other in the vertical direction are connected to each other by the first vertical connecting sub members disposed between the first upper main member and the first lower main member. The second upper main member and the second lower main member which are disposed adjacently to each other in the vertical direction are connected to each other by the second vertical connecting sub members disposed between the second upper main member and the second lower main member. The first upper main member and the second upper main member which are disposed adjacently to each other in the front-rear direction are connected to each other by the first front-rear connecting sub members disposed between the first upper main member and the second upper main member. The first lower main member and the second lower main member which are disposed adjacently to each other in the front-rear direction are connected to each other by the second front-rear connecting sub members disposed between the first lower main member and the second lower main member. Accordingly, the lattice portion of the front side connecting portion can be formed into the structure which can resist the deflection of the right crawler frame front portion and the left crawler frame front portion in the vertical direction more strongly. The lattice portion of the rear side connecting portion can be formed into the structure which can resist the deflection of the right crawler frame rear portion and the left crawler frame rear portion in the vertical direction more strongly. As a result, the deflection amounts of the right crawler frame front portion, the left crawler frame front portion, the right crawler frame rear portion, and the left crawler frame rear portion in the vertical direction can be reduced.

It is preferable that the front side connecting portion is joined to the right crawler frame front portion at two places spaced in the vertical direction and is also joined to the left crawler frame front portion at two places spaced in the vertical direction, and the rear side connecting portion is joined to the right crawler frame rear portion at two places spaced in the vertical direction and is also joined to the left crawler frame rear portion at two places spaced in the vertical direction.

Due to various factors such as, for example, a force which causes a lateral deflection may act on the lower traveling body so that one side of the lower traveling body in the left-right direction is displaced upward or downward with respect to the other side of the lower traveling body. According to the configuration of this embodiment, with respect to the right crawler frame front portion and the left crawler frame front portion, the defection which makes one frame portion displace upward or downward with respect to the other frame portion can be suppressed by two joining portions of the front side connecting portion to the right crawler frame front portion at two upper and lower places and by two joining portions of the front side connecting portion to the left crawler frame front portion at two upper and lower places. Further, with respect to the right crawler frame rear portion and the left crawler frame rear portion, the defection which makes one frame portion displace upward or downward with respect to the other frame portion can be suppressed by two joining portions of the rear side connecting portion to the right crawler frame rear portion at two upper and lower places and by two joining portions of the rear side connecting portion to the left crawler frame rear portion at two upper and lower places. Accordingly, the lateral deflection as described above can be suppressed.

It is preferable that the upper slewing body includes: a slewing body main part which is mounted on the car body; and an attachment which is mounted on the slewing body main part to perform a hanging operation, the attachment includes: a boom which is mounted on the slewing body main part so as to be capable of being raised or lowered; and an optional member which is configured to be attached to and detached from a distal end portion of the boom according to a mode of the hanging operation, the optional member having a lattice structure, and the optional member includes a constitutional member which is configured to be separable from the optional member and has the same structure as the lattice portion such that the constitutional member is capable of being used as the lattice portion of each of the front side connecting portion and the rear side connecting portion.

With such a configuration, by separating the constitutional member from the optional member which is not mounted on the distal end portion of the boom according to a mode of the hanging operation, the constitutional member can be used as the lattice portion of the front side connecting portion or the rear side connecting portion. Accordingly, it is unnecessary to prepare a lattice portion of the front side connecting portion or the rear side connecting portion separately and hence, the number of parts can be reduced.

As described above, according to the embodiment and the modification, it is possible to provide a crawler crane which can enhance hanging ability and can overcome restrictions imposed at the time of transporting the lower traveling body while suppressing the increase in weight attributed to the front side connecting portion and the rear side connecting portion.

This application is based on Japanese Patent application No. 2018-103570 filed in Japan Patent Office on May 30, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A crawler crane comprising:

a crawler-type lower traveling body which is capable of self-traveling; and an upper slewing body which is mounted on the lower traveling body in a slewable manner about a slewing axis which extends in a vertical direction, wherein the lower traveling body includes:

a car body which supports the upper slewing body from below so that the upper slewing body is slewable;

a right crawler device and a left crawler device which are separately disposed on a right side and a left side of the car body and enable traveling of the lower traveling body;

a front side connecting portion which interconnects a front end portion of the car body, the right crawler device and the left crawler device; and a rear side connecting portion which interconnects a rear end portion of the car body, the right crawler device and the left crawler device, the right crawler device includes a right crawler frame which is separably connected to a right end portion of the car body and extends in a front-rear direction, and a right crawler which is disposed so as to surround the right crawler frame and is brought into contact with a ground and performs a circulating motion to generate a propulsion force toward a front side or toward a rear side, the left crawler device includes a left crawler frame which is separably connected to a left end portion of the car body and extends in the front-rear direction, and a left crawler which is disposed so as to surround the left crawler frame and is brought into contact with a ground and performs a circulating motion to generate a propulsion force toward a front side or toward a rear side, the right crawler frame has a right crawler frame front portion which protrudes more frontward than a front end of the car body, and a right crawler frame rear portion which protrudes more rearward than a rear end of the car body, the left crawler frame has a left crawler frame front portion which protrudes more frontward than the front end of the car body, and a left crawler frame rear portion which protrudes more rearward than the rear end of the car body, the front side connecting portion is separably joined to each of the front end portion of the car body, the right crawler frame front portion and the left crawler frame front portion, the front side connecting portion configured to interconnect the front end portion of the car body, the right crawler frame front portion and the left crawler frame front portion in a state where the front side connecting portion is joined to each of the front end portion of the car body, the right crawler frame front portion and the left crawler frame front portion, the rear side connecting portion is separably joined to each of the rear end portion of the car body, the right crawler frame rear portion and the left crawler frame rear portion, the rear side connecting portion configured to interconnect the rear end portion of the car body, the right crawler frame rear portion and the left crawler frame rear portion in a state where the rear side connecting portion is joined to each of the rear end portion of the car body, the right crawler frame rear portion and the left crawler frame rear portion, each of the front side connecting portion and the rear side connecting portion includes a lattice portion which has a lattice structure.

2. The crawler crane according to claim 1, wherein the lattice portion of each of the front side connecting portion and the rear side connecting portion includes:

a plurality of main members which extend in a left-right direction and are arranged parallel to each other; and a plurality of sub members each interconnecting the main members disposed adjacently to each other among the plurality of main members, the plurality of main members include:

a first upper main member; and a first lower main member which is positioned below the first upper main member, and the plurality of sub members include a plurality of first vertical connecting sub members which are arranged at intervals along both a longitudinal direction of the first upper main member and a longitudinal direction of the first lower main member between the first upper main member and the first lower main member, the first vertical connecting sub members connecting the first upper main member and the first lower main member to each other.

3. The crawler crane according to claim 2, wherein the first lower main member is disposed below the first upper main member, the plurality of main members further include:

a second upper main member which is disposed on one side of the first upper main member in the front-rear direction; and a second lower main member which is disposed on the one side of the first lower main member and is disposed below the second upper main member, and the plurality of sub members further include:

a plurality of second vertical connecting sub members which are arranged at intervals along both a longitudinal direction of the second upper main member and a longitudinal direction of the second lower main member between the second upper main member and the second lower main member, the second vertical connecting sub members connecting the second upper main member and the second lower main member to each other;

a plurality of first front-rear connecting sub members which are arranged at intervals along both the longitudinal direction of the first upper main member and the longitudinal direction of the second upper main member between the first upper main member and the second upper main member, the first front-rear connecting sub members connecting the first upper main member and the second upper main member to each other; and a plurality of second front-rear connecting sub members which are arranged at intervals along both the longitudinal direction of the first lower main member and the longitudinal direction of the second lower main member between the first lower main member and the second lower main member, the second front-rear connecting sub members connecting the first lower main member and the second lower main member to each other.

4. The crawler crane according to claim 3, wherein the front side connecting portion is joined to the right crawler frame front portion at two places spaced in the vertical direction and is joined to the left crawler frame front portion at two places spaced in the vertical direction, and the rear side connecting portion is joined to the right crawler frame rear portion at two places spaced in the vertical direction and is joined to the left crawler frame rear portion at two places spaced in the vertical direction.

5. The crawler crane according to claim 3, wherein the upper slewing body includes:

a slewing body main part which is mounted on the car body; and an attachment which is mounted on the slewing body main part to perform a hanging operation, the attachment includes:

a boom which is mounted on the slewing body main part so as to be capable of being raised or lowered; and an optional member which is configured to be attached to and detached from a distal end portion of the boom according to a mode of the hanging operation, the optional member having a lattice structure, and the optional member includes a constitutional member which is configured to be separable from the optional member and has the same structure as the lattice portion such that the constitutional member is capable of being used as the lattice portion of each of the front side connecting portion and the rear side connecting portion.

6. The crawler crane according to claim 2, wherein the front side connecting portion is joined to the right crawler frame front portion at two places spaced in the vertical direction and is joined to the left crawler frame front portion at two places spaced in the vertical direction, and the rear side connecting portion is joined to the right crawler frame rear portion at two places spaced in the vertical direction and is joined to the left crawler frame rear portion at two places spaced in the vertical direction.

7. The crawler crane according to claim 2, wherein the upper slewing body includes:

a slewing body main part which is mounted on the car body; and an attachment which is mounted on the slewing body main part to perform a hanging operation, the attachment includes:

a boom which is mounted on the slewing body main part so as to be capable of being raised or lowered; and an optional member which is configured to be attached to and detached from a distal end portion of the boom according to a mode of the hanging operation, the optional member having a lattice structure, and the optional member includes a constitutional member which is configured to be separable from the optional member and has the same structure as the lattice portion such that the constitutional member is capable of being used as the lattice portion of each of the front side connecting portion and the rear side connecting portion.

8. The crawler crane according to claim 1, wherein the front side connecting portion is joined to the right crawler frame front portion at two places spaced in the vertical direction and is joined to the left crawler frame front portion at two places spaced in the vertical direction, and the rear side connecting portion is joined to the right crawler frame rear portion at two places spaced in the vertical direction and is joined to the left crawler frame rear portion at two places spaced in the vertical direction.

9. The crawler crane according to claim 8, wherein the upper slewing body includes:

a slewing body main part which is mounted on the car body; and an attachment which is mounted on the slewing body main part to perform a hanging operation, the attachment includes:

a boom which is mounted on the slewing body main part so as to be capable of being raised or lowered; and an optional member which is configured to be attached to and detached from a distal end portion of the boom according to a mode of the hanging operation, the optional member having a lattice structure, and the optional member includes a constitutional member which is configured to be separable from the optional member and has the same structure as the lattice portion such that the constitutional member is capable of being used as the lattice portion of each of the front side connecting portion and the rear side connecting portion.

10. The crawler crane according to claim 1, wherein the upper slewing body includes:

a slewing body main part which is mounted on the car body; and an attachment which is mounted on the slewing body main part to perform a hanging operation, the attachment includes:

a boom which is mounted on the slewing body main part so as to be capable of being raised or lowered; and an optional member which is configured to be attached to and detached from a distal end portion of the boom according to a mode of the hanging operation, the optional member having a lattice structure, and the optional member includes a constitutional member which is configured to be separable from the optional member and has the same structure as the lattice portion such that the constitutional member is capable of being used as the lattice portion of each of the front side connecting portion and the rear side connecting portion.

* * * * *